US008330387B2

(12) United States Patent
York et al.

(10) Patent No.: US 8,330,387 B2
(45) Date of Patent: Dec. 11, 2012

(54) SOLID-STATE LIGHTING DEVICE

(75) Inventors: Allan Brent York, Langley (CA); Ingo Speier, Saanichton (CA)

(73) Assignee: Koninklijke Philips Electronics N.V., Eindhoven (NL)

( * ) Notice: Subject to any disclaimer, the term of this patent is extended or adjusted under 35 U.S.C. 154(b) by 428 days.

(21) Appl. No.: 12/598,285

(22) PCT Filed: May 1, 2008

(86) PCT No.: PCT/IB2008/051700

§ 371 (c)(1),
(2), (4) Date: Oct. 30, 2009

(87) PCT Pub. No.: WO2008/135927

PCT Pub. Date: Nov. 13, 2008

(65) Prior Publication Data

US 2010/0134016 A1 Jun. 3, 2010

Related U.S. Application Data

(60) Provisional application No. 61/030,481, filed on Feb. 21, 2008, provisional application No. 60/915,616, filed on May 2, 2007.

(51) Int. Cl.
*H05B 37/00* (2006.01)

(52) U.S. Cl. ..... 315/291; 315/112; 315/308

(58) Field of Classification Search ..... 315/291, 315/307, 308, 112, 117, 118, 312, 313, 323
See application file for complete search history.

(56) References Cited

U.S. PATENT DOCUMENTS

| | | | | |
|---|---|---|---|---|
| 6,166,491 | A * | 12/2000 | Tsuchiya et al. | 315/169.3 |
| 6,495,964 | B1 | 12/2002 | Muthu et al. | |
| 7,307,391 | B2 * | 12/2007 | Shan | 315/291 |
| 2005/0212439 | A1 * | 9/2005 | Zampini et al. | 315/86 |
| 2006/0001384 | A1 | 1/2006 | Tain et al. | |
| 2006/0006821 | A1 | 1/2006 | Singer et al. | |

OTHER PUBLICATIONS

California Energy Commission, LED Low-Profile Fixture Designs, Rensselaer Polytechnic Institute Lighting Research Center, 2005, pp. 1-2, California, www.lrc.rpi.edu/programs/solidstate/.

* cited by examiner

*Primary Examiner* — David Hung Vu
(74) *Attorney, Agent, or Firm* — John F. Salazar; Mark L. Beloborodov

(57) ABSTRACT

A solid-state lighting device (500) includes a plurality of light-emitting elements (510, 525, 530) configured for generating light that are thermally coupled to a heat spreading chassis configured for coupling to one or more heat sinks (520). The lighting device further includes a mixing chamber which is optically coupled to the plurality of light-emitting elements and configured to mix the light emitted by the plurality of light-emitting elements. A control system is operatively coupled to the plurality of light-emitting elements, and configured to control operation of the plurality of light-emitting elements.

10 Claims, 29 Drawing Sheets

SOLID-STATE LIGHTING DEVICE

FIELD OF THE INVENTION

The present invention pertains to lighting and more particularly to solid-state lighting devices.

BACKGROUND

Many conventional luminaries utilize incandescent or various types of fluorescent light sources. Limitations of many different types of luminaries stem from the need to address the dissipation of high amounts of heat, specifically from incandescent light sources. Known solutions include luminaire designs that are intended to be used in well ventilated setups, in which most of the outside surface of the luminaire—for example, a suspended spot light—is exposed to facilitate heat dissipation into the ambient environment via convection. Other luminaries, intended for applications where effective cooling via convection is limited, are often designed to dissipate waste heat via radiation or heat conduction. Such luminaries include so-called "recessed lights," such as broad-angle flood lights and narrow-angle spot lights, designed for installation into insulated openings in walls or ceilings. Luminaries based on conventional light sources, while providing reasonably effective heat dissipation via radiation, suffer from lack of effective color and intensity control, low luminous efficacy, and a host of other disadvantages.

Recently, advances in the development and improvements of the luminous flux of light-emitting devices such as solid-state semiconductor and organic light-emitting diodes (LEDs) have made these devices suitable for use in general illumination applications, including architectural, entertainment, and roadway lighting. Functional advantages and benefits of LEDs include high energy conversion and optical efficiency, durability, lower operating costs, and many others, making LED-based light sources increasingly competitive with traditional light sources, such as incandescent, fluorescent, and high-intensity discharge lamps. Also, recent advances in LED technology and ever-increasing selection of LED wavelengths to choose from have provided efficient and robust white light and colour-changing LED light sources that enable a variety of lighting effects in many applications.

Many existing solid-state luminaries and luminaire designs, however, are complex, include large numbers of components and as a result their manufacturing can be resource- and cost-intensive. For example, maintaining a proper junction temperature is an important component to developing an efficient solid-state lighting system, as the LEDs perform with a higher efficacy when run at cooler temperatures. The use of active cooling via fans and other mechanical air moving systems, however, is typically discouraged in the general lighting industry primarily due to its inherent noise, cost and high maintenance needs. Thus, it is desirable to achieve air flow rates comparable to that of an actively cooled system without the noise, cost or moving parts, while minimizing the space requirements of the cooling system.

A number of solutions have been proposed, addressing the disposition of solid-state light sources and the configuration of cooling systems of luminaries in order to facilitate the heat dissipation and to mitigate undesirable effects caused by heating of solid-state light sources. Some examples include a number of products suitable for operation in recessed installations such as, a number of lighting products offered by various manufacturers that include 360 lm white LEDs manufactured by Cree Inc., or the LED Low-Profile Fixture Designs provided by the California Energy Commission in cooperation with the Architectural Energy Corporation and the Rensselaer Polytechnic Institute Lighting Research Center described at http://www.lrc.rpi.edu/programs/solidstate/.

Many known solutions, however, fail suggest a solid-state lighting device that provides good thermal management in combination with a modular configuration that allows adequate maintenance, replacement or repair of its components. There is, therefore, a need for a luminaire employing LED-based light sources that addresses a number of disadvantages of known solid-state lighting devices, particularly those associated with thermal management, light output, and ease of installation and maintenance.

This background information is provided to disclose information believed by the applicant to be of possible relevance to the present invention. No admission is necessarily intended, nor should be construed, that any of the preceding information constitutes prior art against the present invention.

SUMMARY OF THE INVENTION

Applicants have recognized and appreciated that LED-based lighting devices can be configured to provide a number of benefits that can improve overall heat dissipation in combination with a modular luminaire design. Lighting devices according to various embodiments of the present invention, can be configured, to provide good heat dissipation from the LEEs either directly or indirectly into the environment and/or to provide good quality of the light emitted from the lighting device within the constraints of a predetermined heat dissipation budget. Some of the embodiments and implementations of the invention relate to a lighting device that is particularly suitable for operation in confined spaces such as wall or ceiling recesses.

Generally, in one aspect, the invention focuses on a solid-state lighting device. The device includes a including a plurality of light-emitting elements for generating light, including at least one light-emitting element having a first surface area and a heat spreading chassis thermally connected to the plurality of light emitting elements. The heat spreading chassis is configured for coupling to at least one heat sink. The device further includes a mixing chamber optically coupled to the plurality of light-emitting elements for to mixing the light emitted by the plurality of light-emitting elements; and a control system operatively coupled to the plurality of light-emitting elements for controlling operation of the plurality of light-emitting elements.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION OF THE INVENTION

Relevant Terminology

Figure 1:
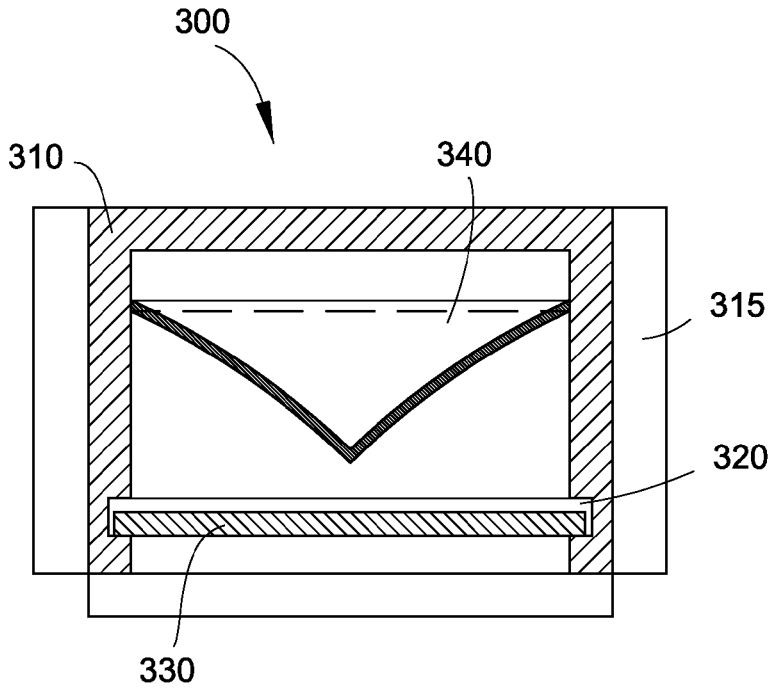
FIG. 1 schematically illustrates a cross-section of a lighting device according to some embodiments of the present invention.

The term "light-emitting element" (LEE) is used to define a device that emits radiation in a region or combination of regions of the electromagnetic spectrum, for example, the visible region, infrared or ultraviolet region, when activated by applying a potential difference across it or passing an electrical current through it, because of, at least in part, electroluminescence. LEEs can have monochromatic, quasi-monochromatic, polychromatic or broadband spectral emission characteristics. Examples of LEEs include semiconductor, organic, or polymer/polymeric light-emitting diodes (LEDs), optically pumped phosphor coated LEDs, optically pumped nano-crystal LEDs or other similar devices as would be readily understood. Furthermore, the term LEE is used to define the specific device that emits the radiation, for example a LED die, and can equally be used to define a combination of the specific device that emits the radiation together with a housing or package within which the specific device or devices are placed. The term "solid-state lighting" is used to refer to types of illumination which can be used for space or decorative or indicative purposes, and which is provided by manufactured light sources such as for example fixtures or luminaries, which at least in part can generate light because of electroluminescence.

Further, as used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization. For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources. A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light. The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K. Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The term "lighting fixture" or "luminaire" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs). In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present disclosure discussed herein. The terms "program" or "computer program" are used herein in a generic sense to refer to any type of computer code (e.g., software or microcode) that can be employed to program one or more processors or controllers.

It should also be appreciated that terminology explicitly employed herein that also may appear in any disclosure incorporated by reference below should be accorded a meaning most consistent with the particular inventive concepts disclosed herein. Unless defined otherwise, all technical and scientific terms used herein have the same meaning as commonly understood by one of ordinary skill in the art to which this invention belongs.

Overview

The present invention generally relates to a lighting device suitable for confined spaces, such as, for example, recesses and alcoves, and offers improved overall heat dissipation in combination with a modular luminaire design. Lighting devices according to embodiments of the present invention, can be configured, for example, to provide good heat dissipation from the LEEs either directly or indirectly into the environment or to provide good quality of the light emitted from the lighting device within the constraints of a given heat dissipation budget, for example. The lighting devices includes a number of light-emitting elements (LEEs) disposed on a substrate that are operatively connected to a source of electrical energy. The lighting device may further include (i) an optical system for interacting with at least a portion of the light emitted by the LEEs before the light is released from the lighting device and (ii) a control system for controlling the form and amount of electrical energy supplied to the LEEs.

In one embodiment of the present invention, a solid-state lighting device comprising a plurality of light-emitting elements which are configured for generating light. These light-emitting elements are thermally coupled to a heat spreading chassis configured for coupling to one or more heat sinks. The lighting device further includes a mixing chamber which is optically coupled to the plurality of light-emitting elements and configured to mix the light emitted by the plurality of light-emitting elements. Also included is a control system operatively coupled to the plurality of light-emitting elements, and configured to control operation of the plurality of light-emitting elements.

FIG. 1 schematically illustrates a cross-section of a lighting device 300, according to some embodiments of the present invention. The lighting device includes a heat spreading chassis 310 thermally connected to exterior cooling fins 315 or other exterior surface-increasing elements to improve air convection. The chassis can be configured in various forms, including linear, curved, or curvilinear. The inside surface of the heat spreading chassis can have a groove 320 or other mounting means for disposing a thermally conductive substrate 330 containing LEEs therein. In one embodiment, the substrate 330 is flexible and can be resiliently biased into the groove or other mounting means in order to achieve a desired level of thermal interconnectivity between the LEEs and the heat spreading chassis. The lighting device further includes an optical system 340 which can provide for the manipulation of the light, for example redirection of the emitted light out of the lighting device. The heat spreading chassis can be thermally coupled to a heat sink or other heat dissipation configuration which can thereby provide for the dissipation of heat generated by the LEEs into the environment. In one version of this embodiment, multiple LEEs are provided on the substrate 330 in series and electrically connected via conductive traces. Further, a conversion layer comprising phosphor may be included over the LEEs.

Figure 2A:
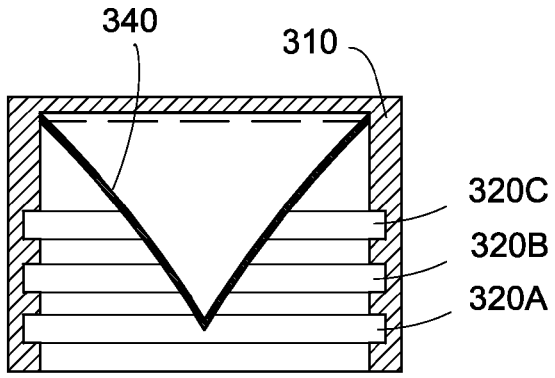
FIG. 2A schematically illustrates a cross-section of a lighting device according to other embodiments of the present invention.
Figure 2B:
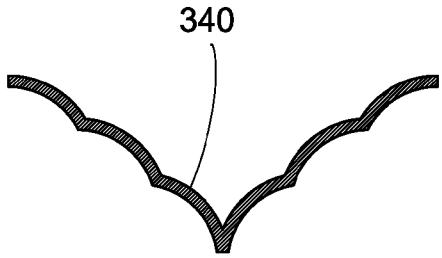
FIG. 2B schematically illustrates a cross-section of an optical element suitable for the lighting device shown in FIG. 2A.

FIG. 2A illustrates a cross-section of a lighting device according to another version of the embodiment shown in FIG. 3, wherein the heat spreading chassis 310 defines multiple grooves 320A, 320B, and 320C and/or includes other mounting means for disposing substrates with LEEs therein or otherwise engaging those substrates to the chassis. For example, the LEEs can be arranged on one or more substrates which can be resiliently biased against the inside of the heat spreading chassis in the groove therein. The lighting device further comprises an optical system 340 which can provide for the manipulation of the light, for example redirection of the emitted light out of the lighting device. The optical system may be configured as a reflector having a scalloped configuration as illustrated in FIG. 2B.

Figure 3A:
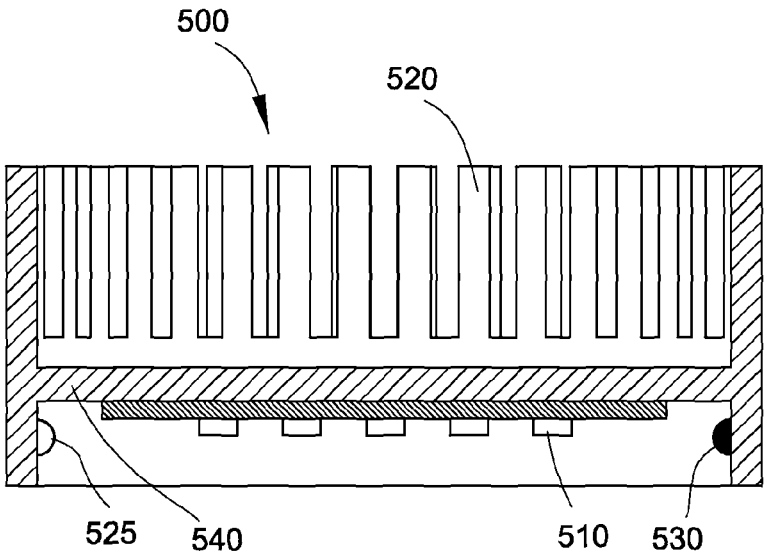
FIG. 3A schematically illustrates a cross-sectional view of a lighting device according to an embodiment of the present invention.
Figure 3B:
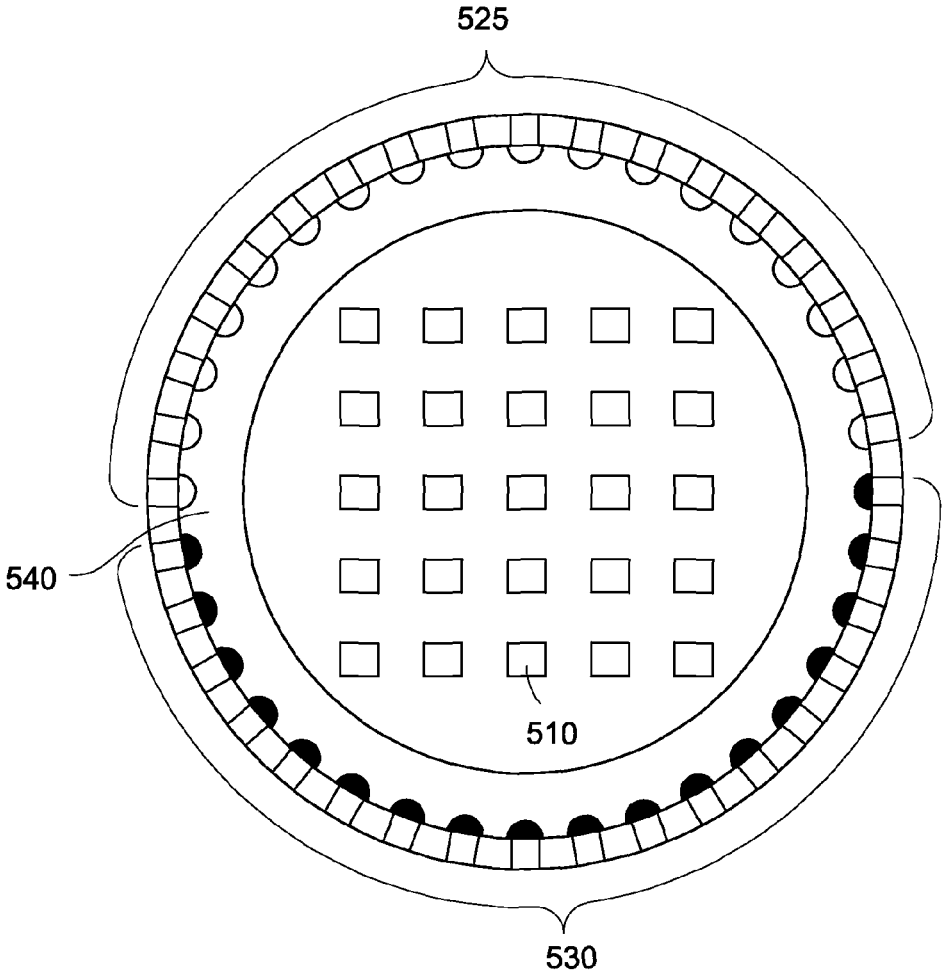
FIG. 3B illustrates a top view of the lighting device of FIG. 3A.

FIGS. 3A and 3B schematically illustrate a cross-section and plan view, respectively, of a lighting device 500 according to other embodiments of the present invention. The lighting device includes a plurality of white LEEs 510 positioned on a heat sink 520 in the middle or on an inside surface of a rear wall of the lighting device. The blue light-emitting elements 525 and green LEEs 530 are located around the inner curved surface of the heat spreading chassis 540, wherein these light-emitting elements may be biased into a groove formed therein as discussed above with reference to FIGS. 1-2. The lighting device further includes optical elements, which can be configured to redirect the light emitted by the green and blue LEEs out of the lighting device.

Thermal Management

Thermal management considerations relating to the heat generated by the plurality of light-emitting elements generally dictate design configurations of the lighting device. In various embodiments of the present invention, the positioning of the light-emitting elements in relation to the heat spreading chassis or other thermal management device is considered in order to provide a desired level of thermal transfer from the light-emitting elements. In addition, in some embodiments of the present invention, size, configuration, and packaging of LEEs can be chosen to mitigate the concentration of heat generated by them. Furthermore, according to embodiments of the present invention, a heat spreading chassis is thermally coupled to a plurality of the light-emitting elements of the lighting device, wherein the heat spreading chassis can provide for the ease of coupling to a heat sink or other heat dissipation system in a desired manner and with a desired level of thermal connectivity.

Light-Emitting Element Placement

Figure 4A:
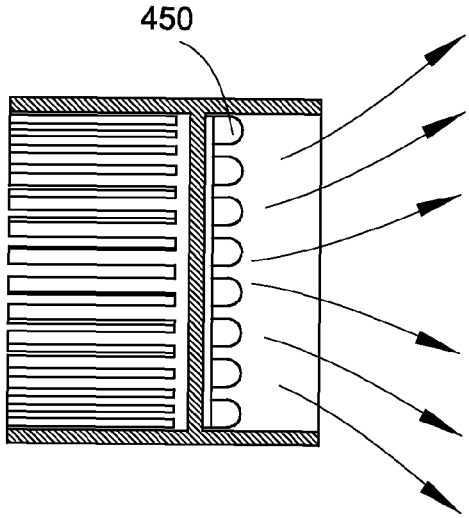
FIGS. 4A-4B schematically illustrates cross-sectional views of lighting devices according to some embodiments of the present invention.
Figure 4B:
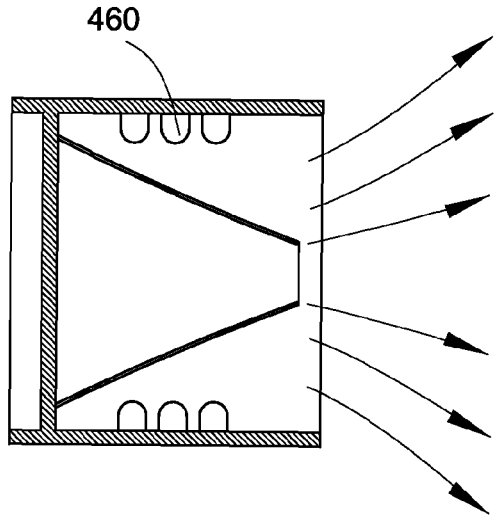

Different embodiments of the present invention may employ different positioning schemes of LEEs. FIGS. 4A and 4B schematically illustrates two different exemplary arrangements of LEEs within a lighting device according to some embodiments of the present invention. Referring to FIG. 4A, the LEEs 450 are mounted on a plate in the middle of the housing and point directly towards the exit aperture of the lighting device. This arrangement can provide efficient light emission but may suffer from inferior heat dissipation characteristics due to extended thermal paths from the LEEs to the exterior of the lighting device. Referring FIG. 4B, the LEEs 460 are mounted close to and in good thermal connection with, the outer exterior of the lighting device. This configuration can facilitate and improve heat dissipation from the LEEs to the environment. Additionally required optical elements such as reflectors, for example, that can redirect LEE light toward the exit aperture of the lighting device may, however, provide for inferior overall lighting device efficiency. Embodiments of the present invention may, however, utilize a combination of these or other mounting positions.

Figure 5:
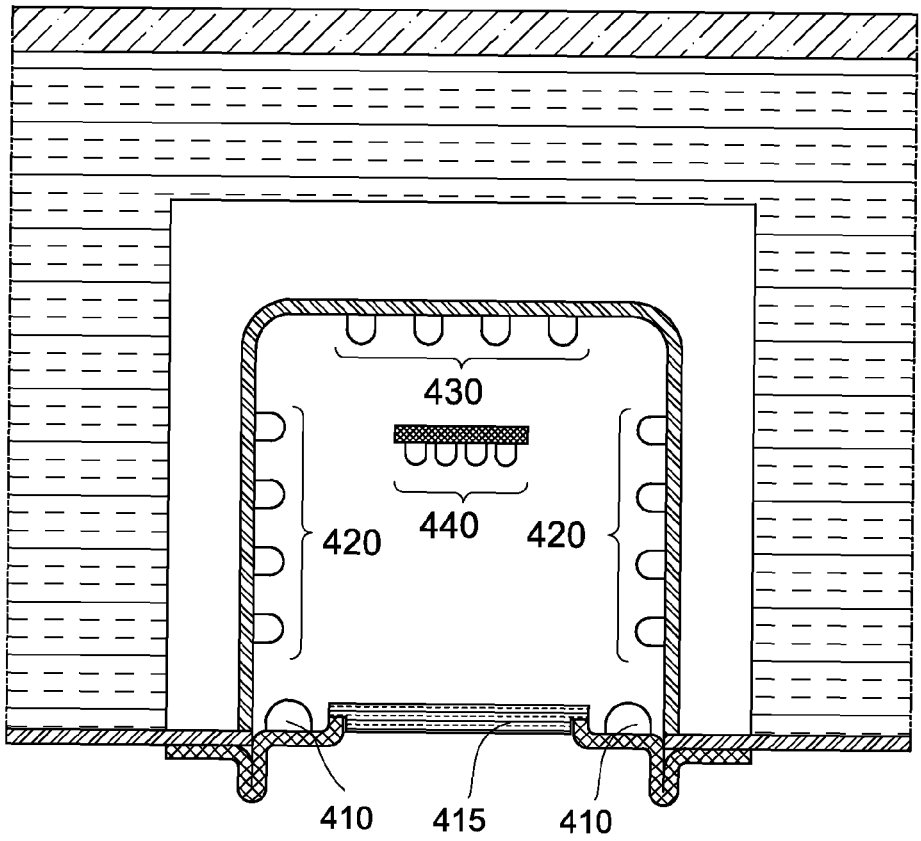
FIG. 5 schematically illustrates different LEE positions in lighting devices according to various embodiments of the present invention.

FIG. 5 illustrates different mounting configurations of LEEs within a lighting device in accordance with different embodiments of the present invention. As illustrated in FIG.

5, reference numeral 410 refers to a configuration with LEEs which can be mounted proximate to an exit aperture 415 of the lighting device, for example, on a trim ring facing the inside of the lighting device. This configuration provides short thermal paths for heat from the LEEs to dissipate to the environment and consequently potentially good LEE and luminaire cooling. This configuration, however, may provide reduced optical efficiency for forward emitting LEEs as the emitted light has to be back-reflected to reach the output aperture of the lighting device. As indicated by reference numeral 420, LEEs can also be disposed along an inside surface concentric about an axis of the lighting device. This configuration may provide good thermal connectivity to the environment also in line with improved optical efficiency as a smaller angle of reflection is required to redirect light emitted from forward emitting LEEs to the exit aperture of the lighting device. As indicated by reference numeral 430, LEEs can also be disposed on an inside surface of the back wall lighting device. This configuration provides relatively long thermal paths for heat to reach a well ventilated portion of the outside of the lighting device. LEEs can also be disposed according to configuration 440 on a substrate within the lighting device. The substrate can be thermally connected to thermally well conducting components such as cooling elements, heat pipes etc. Configurations 430 and 440, however, can offer efficient light extraction from the lighting device as it facilitates collimation of light from LEEs.

According to embodiments of the present invention, different types of LEEs can be utilized in a lighting device design and can be adequately positioned according to the type of LEE. For example, the most thermally sensitive LEEs can be placed in accordance with configuration 410 or a similar configuration near the exit aperture of the lighting device. Other types of LEEs can be disposed according to configurations 420, 430, or 440 or other adequate configurations, for example, depending on the specific requirements of the LEEs of those types.

Light-Emitting Element Configuration

Small LEEs can provide small power densities and may generate less waste heat than large LEEs. Component cost of large numbers of small LEEs is typically lower than that of small numbers of large LEEs. It is noted that luminaire with a large number of small LEEs may provide additional benefits and may be useful for certain applications. Lighting devices according to certain embodiments of the present invention may comprise a relatively large number of small or relatively less powerful LEEs. Lighting devices according other embodiments of the present invention may comprise a relatively small number of large or relatively powerful LEEs. Moreover, lighting devices according to further embodiments of the present invention may comprise both small and large LEEs.

Figure 6A:
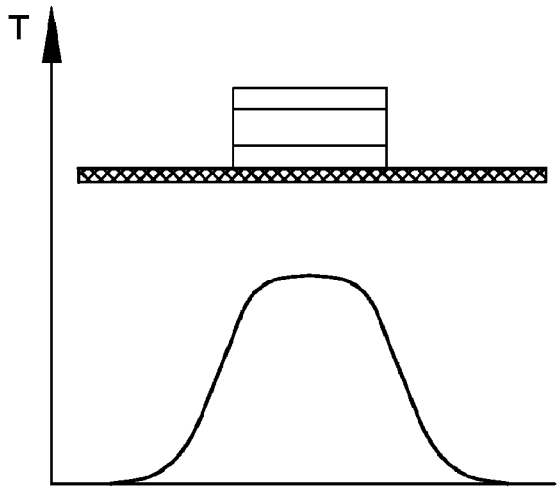
FIG. 6A-6B illustrates substrate temperature profiles for some exemplary configurations of LEEs on a substrate.
Figure 6B:
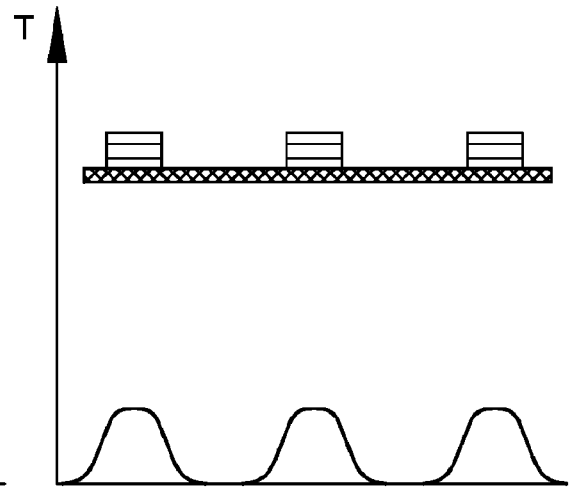

FIGS. 6A and 6B illustrate equilibrium temperature profiles for two configurations of LEEs. Specifically, FIG. 6A illustrates one large LEE and FIG. 6B illustrates three small LEEs, each being operatively disposed on a substrate. The LEEs are operated under certain static test operating conditions to illustrate the effect on the temperature profile of the two different configurations. As illustrated in FIG. 6B, smaller spread out LEEs that typically generate smaller amounts of waste heat within an area or volume comparable in size to that of a single larger LEE of comparable efficiency as illustrated in FIG. 6A, typically generate a spatially smoother, less concentrated heat load and consequently expose the substrate and the LEEs and other components or devices to reduced thermally induced stress. Similar considerations also apply for heat dissipating devices other than LEEs. FIGS. 6A and 6B also illustrates that the temperature gradients and maximum temperatures of the temperature profile of a distributed set of small LEEs can exhibit smaller gradients and less extreme temperatures in comparison to a single chip producing the same amount of light. Covering large areas with a large number of small LEEs can also facilitate heat transfer to one or more heat sinks or direct dissipation of waste heat into the environment.

Heat Dissipation

For efficient heat dissipation it can be beneficial to spread out the heat sources. Heat sources in lighting devices according to embodiments of the present invention can be accordingly disposed. Lighting devices according to embodiments of the present invention can also include adequately configured heat dissipating or heat spreading elements that provide a heat sinking function while also providing one or more other functions and can provide good heat dissipation such as a suitably configured chassis or housing, for example. The lighting device and the heat spreading elements can be configured so that the lighting device can be operated under intended operating conditions in different orientations or in confined spaces or both. For example, a housing can be made of thermally conductive material such as aluminum or aluminum alloys, for example. Heat dissipation capabilities can also be improved by increasing the surface to volume ratio of one or more heat dissipating or heat spreading elements even beyond that required by that element to provide sufficient mechanical strength or rigidity. For example, the shape of the housing can be relatively flat rather than relatively cubic or spherical, while still maintaining an adequately compact lighting device. Components of a lighting device that can be configured to provide a relatively flat shape can be disposed so that they are in good thermal contact with and provide a short thermal path to the LEEs and other heat sources that are included in the lighting device.

The housing can also be configured to provide good thermal contact to optional heat dissipation elements such as external heat sinks, for example, to provide good heat dissipation to the environment via convection.

Lighting device according to embodiments of the present invention can be configured so that the LEEs are adequately thermally isolated from other sub-systems such as the control system, the drive system or the sensor system or at least from certain components of the sub-systems. It is noted that during operation of a lighting device, rapid temperature changes and temperature distribution changes can occur within the LEEs which can cause thermal stress in the LEEs and other components that are in thermal contact with the LEEs. Thermally isolating other components of a lighting device such as optional current or optical sensors, for example, can be employed to provide accurate control over a number of operating conditions of the lighting device or the light emitted it or both.

Light-Emitting Element Interconnection

Figure 7:
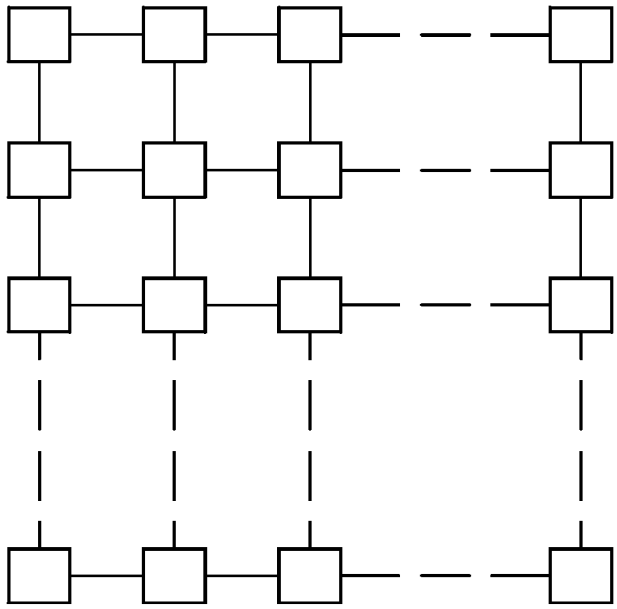
FIG. 7 illustrates an interconnect scheme for LEEs according to an embodiment of the present invention.

LEEs can be connected in strings or otherwise interconnected in order to prevent LEEs from extinguishing if one or more LEEs fail. Referring to FIG. 7, in one embodiment of the present invention, LEEs are interconnected to improve availability in case of single or multiple failures. As illustrated, LEEs can be arranged in a matrix of parallel multiple interconnected strings. If an LEE in a string fails, the electrical current may divert at the broken LEE to another branch or segment and slightly increase drive current of the other LEEs in the branches or segments parallel to the broken LEE while typically only marginally affecting the drive current through other branches or segments LEEs. It is noted that other embodiments of the present invention may employ other LEE interconnections, such as a combination of series and parallel wired branches.

Control/Drive System

In various embodiments of the present invention, the lighting system includes a control system for controlling the drive currents through the LEEs. The control system can be configured in different ways to provide one or more predetermined control functions. The control system can employ a one or more different feed-forward or feedback control mechanisms or both. According to one embodiment of the present invention, a control system can employ drive-current feedback. Corresponding lighting devices can include one or more drive current sensors for sensing one or more LEE drive currents under operating conditions that provide one or more signals that are indicative of the respective drive currents. According to another embodiment of the present invention, a control system can employ optical feedback.

Corresponding lighting device can include one or more drive optical sensors for sensing the light emitted by one or more LEEs that provide one or more signals that are indicative of the respective intensities of the sensed light. Lighting device can also comprise one or more temperature sensors for sensing the operating temperatures of one or more components of the lighting device. Suitable temperature sensors for use in embodiments of the present invention can include elements that provide practically useful thermo-resistive or thermo-electric effects, which make them change resistance or provide a certain voltage in correspondence with operating temperature changes. Operating temperature of many types of LEEs can also be inferred from a combination of instant LEE forward voltages and LEE drive current, as would be readily understood by a person skilled in the art.

The control system can be configured to process feedback signals provided by one or more drive current sensors or one or more optical sensors or other sensors configured to provide information about one or more operational conditions of the lighting device, for example. The control system can be configured to determine or provide or determine and provide LEE drive currents based upon feed forward configuration parameters of the control system. The control system can also employ a combination of feed forward and feedback methods for the same or different control parameters or feedback signals.

Lighting device according to embodiments of the present invention that include multi-color LEE based lighting devices, can be configured to employ optical feedback control. In such lighting devices, the intensity of the light emitted by like-color LEEs can be determined in a number of different ways. For example, intensity can be determined by comparing a measured signal strength acquired when all LEEs are ON, with the signal strength when the LEEs of the color of interest are OFF. If a measurement requires that the LEEs are turned OFF while they otherwise do not need to be, a shortfall in the intended intensity contribution of that color due to the switching OFF can be compensated for, by, for example, adding back an ON pulse in pulse width modulation (PWM) controlled systems, towards the end of the cycle in which the measurement was taken. Deviations of the chromaticity of the light emitted by the lighting devices from an intended chromaticity can be determined by the control system based on the acquired measurements.

Furthermore, in one embodiment, a measurement for a single color can be made when all LEEs except the ones that emit light of the color of interest are OFF. Again, if the measurement requires that LEEs are turned OFF while they otherwise do not need to be, adding back compensating pulses for the switched off color LEEs at the end of a pulse cycle in pulse width controlled systems, can be used to compensate for otherwise occurring unintended effects. Certain multi-color LEE-based PWM controlled lighting devices may be configured to determine the intensity of the light emitted by one or even more like-color LEEs during operating conditions per PWM cycle. It is noted that it is also possible to compensate for sensed ambient light by comparing the optical signal when all LEEs are ON to that when they are all off. Again, deviations of the chromaticity of the light emitted by the lighting device from an intended chromaticity can be determined by the control system based on the acquired measurements.

In one embodiment, the control system can be configured to automatically adjust gain levels for the signals provided by the optical or drive current sensors. The control system can be configured to perform the adjustment in a feedback manner based on the strength of the sensed signal or the time-average of a monitored signal. Alternatively, the adjustment can be made based in a feed forward manner, based on, for example, the level of light output that is expected for LEEs of like color for the intended operating conditions. The gain can be determined according to these or other methods such that the measurement resolution can be improved. The intensity per color can then be determined and utilized by the control system in order to maintain the combined light output at the desired level. In PWM controlled lighting device, the gain may be changed on a per pulse basis, for example.

Figure 8:
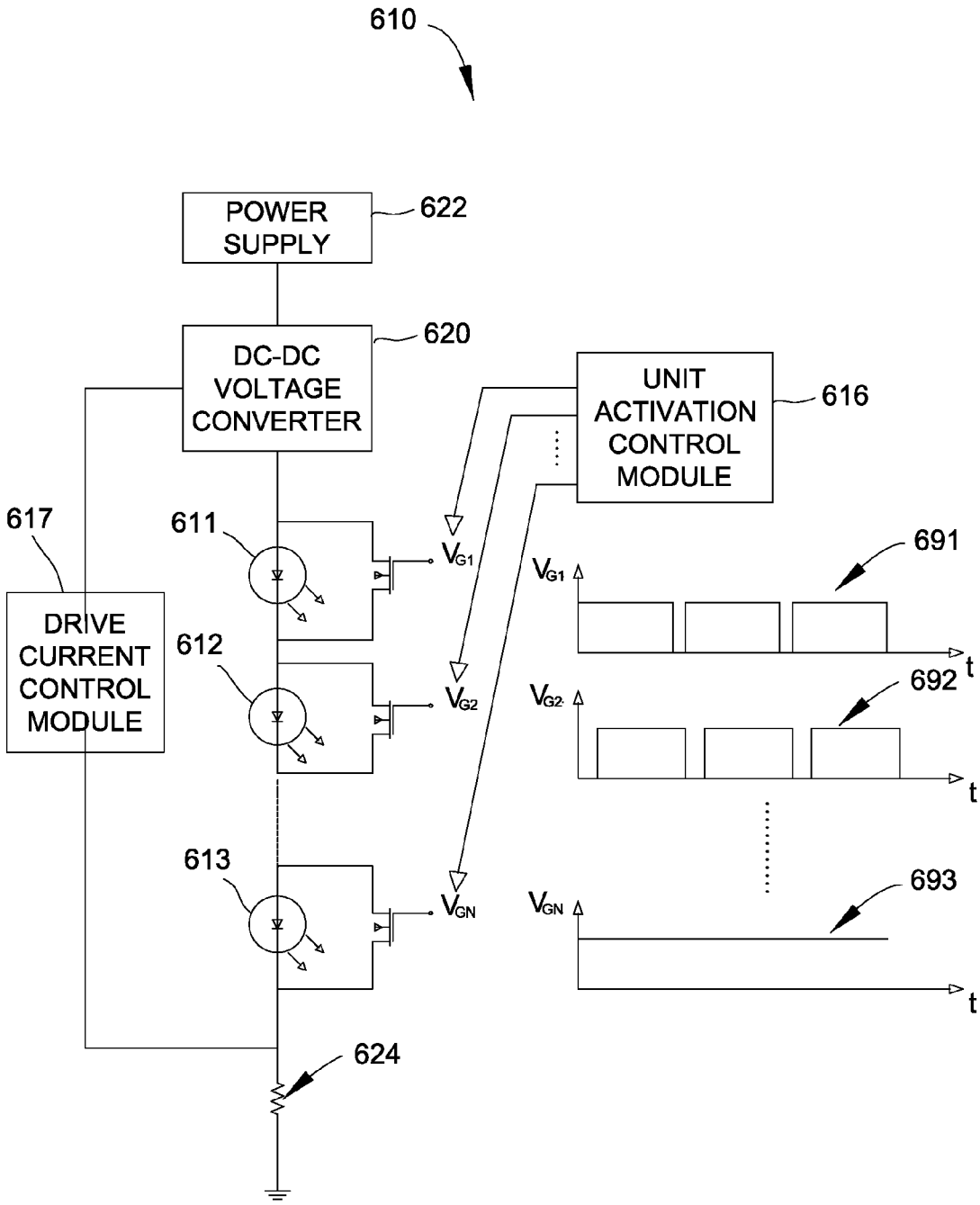
FIG. 8 illustrates a block diagram of an example control system for a lighting device according to one embodiment of the present invention.

FIG. 8 illustrates a block diagram of a control system 610 for a lighting device according to various embodiments of the present invention. The control system is configured to control a series connection of one or more (three are illustrated) groups of LEEs 611, 612 and 613 and is operatively connected to a drive current control module 617, a DC-DC voltage converter 620, a power supply 622, and a resistor 624. Each one of the N groups of LEEs 611, 612 to 613 is operatively connected to a parallel field effect transistor (FET). The gate electrodes of each field effect transistor are operatively connected to a unit activation control module 616. The unit activation control module 616 maybe integrated with the current control module 617, for providing switching or activation signals to each of the LEE units, thereby enabling separate control of each of the LEE groups. FIG. 8 also illustrates examples of gate switching signals 691, 692 and 693 for the gate voltages VG1, VG2 to VGN for the FETs of each LEE group 611, 612 and 613.

The drive current control module 617 probes the voltage drop across resistor 624 which acts as a current sensor. The drive current control module 617 provides a feedback signal to DC-DC voltage converter 620. In this embodiment, the drive current flows substantially either through one of the groups of LEEs or through FET corresponding to that group. Hence adequate electrical drive current can be provided to each of the LEE groups by turning the corresponding FET ON or OFF, depending on whether the source-drain channel of the corresponding FET open or closed or to which degree is open or closed.

To keep the number of electronic components and devices otherwise required to provide a suitable forward voltage for LEE interconnections low, an adequate number of LEEs can be operatively connected in series into a string of LEEs. Strings with higher numbers of series-connected LEEs typically require higher drive voltages and generally draw lower output currents from an operatively attached power supply than strings with higher number of parallel strings but lower number of LEEs per string for comparable total power consumption and light output. In one embodiment, there are half as many driving channels as there are strings of LEEs. For example, there may be four independent strings and two driving channels.

Certain LEEs require low forward voltages typically of the order of one to ten volts depending on the type of the LEE when forward biased to generate drive currents suitable for achieving nominal operating conditions. The LEE interconnections can be configured, for example, in a serial or mixed serial-parallel interconnection of an adequate number of LEEs in order to match the LEE forward voltage requirements of the LEE interconnection with the output voltage of the power supply. For example, the LEEs may be serially interconnected into one or more parallel strings. Suitably configured LEE interconnections can be used in combination with certain power supplies that impose relaxed configuration requirements on the power supply. The use of such power supplies in or in combination with luminaire according to embodiments of the present invention can be more cost effective. The number of LEEs that need to be serially connected can be determined based on the forward voltage of each LEE and the drive voltage supplied to the string as would be readily understood by a person skilled in the art.

It is noted that the luminaire according to the present invention may comprise LEEs of different types such as different color and that LEEs of different types may require different forward voltages. The type of LEE can depend on a number of characteristics including the materials employed in the LEE, the composition of the materials and the design of the LEE, for example. The type of LEE may affect the color and spectrum of the light emitted by the LEE under operating conditions.

For example, a series connection of 50 LEEs of the same nominal kind, each having a nominal forward voltage of 3V requires about 150V to be able to achieve the respective nominal drive current. A rectified 120V RMS AC, 60 Hz supply line provides a peak voltage of $120*2^{1/2}$V or about 170V and nominally requires about 57 LEEs, each having 3V forward voltage, if no voltage losses are taken into account. It is noted that through electrical connections and other components of a lighting device such as an optional control system, for example, the voltage provided by the power supply can be reduced before it becomes available to the LEEs. For example, 50 LEEs of 3V nominal forward voltage each may be safely directly operated at 120 V RMS 60 Hz sinusoidal line voltage, for example. Certain LEEs or LEE configurations may also be operated at elevated forward voltages above their nominal forward voltage depending on the configuration of the lighting device or its components or the application, for example.

Figure 9A:
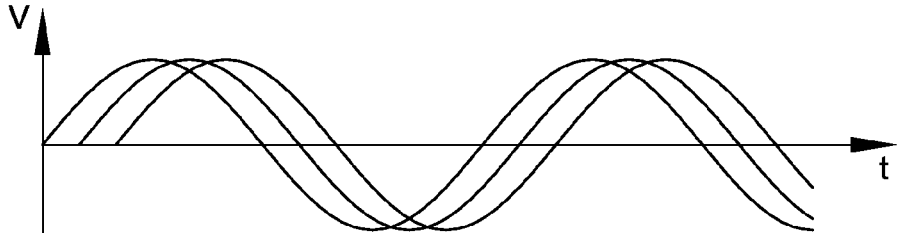
FIGS. 9A-9C illustrate time diagrams of voltage waveforms for use in lighting devices according to embodiments of the present invention.
Figure 9B:
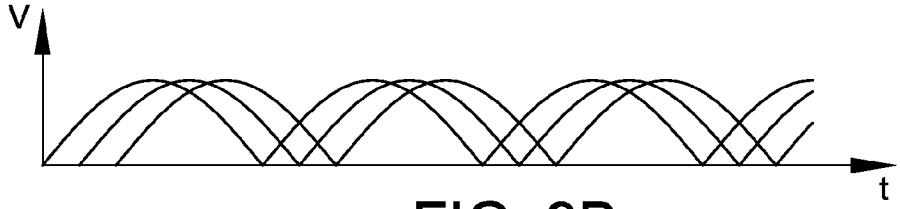
Figure 9C:
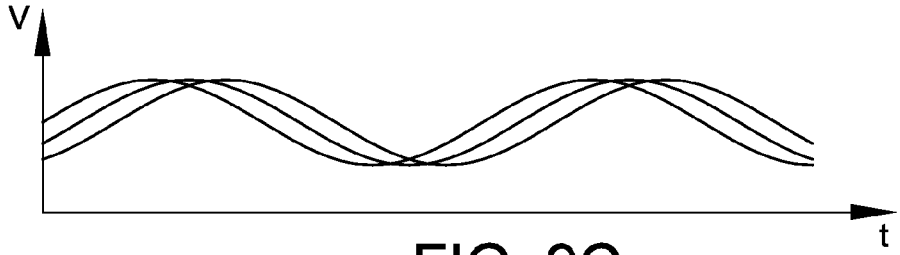

According to this embodiment, each string in the lighting device is interdependently driven by a full wave rectified AC power source derived from a single phase power supply. The drive current for each string is set in accordance with the desired color or CCT of the mixed light. As is illustrated in FIGS. 9A-9C, the drive currents which are supplied to each LEE string can be phase shifted relative to each other in order to reduce undesired perceivable flicker. It is noted that respective phase-shifting techniques and electronic circuits are widely known in the art. For example, FIG. 9A illustrates the AC signal in a phase shifted format, FIG. 9B illustrates that AC signal rectified into a DC format, and FIG. 9C illustrates the signal after smoothing. In one particular embodiment, the drive currents for each color are phase shifted relative to each other, such that the variation in luminous intensity due to the sum of the colored light emitted by the LEEs is minimized. It is known that the human visual system is less sensitive to rapid and repetitive changes in chromaticity than it is to rapid and repetitive changes in luminous intensity.

Figure 10:
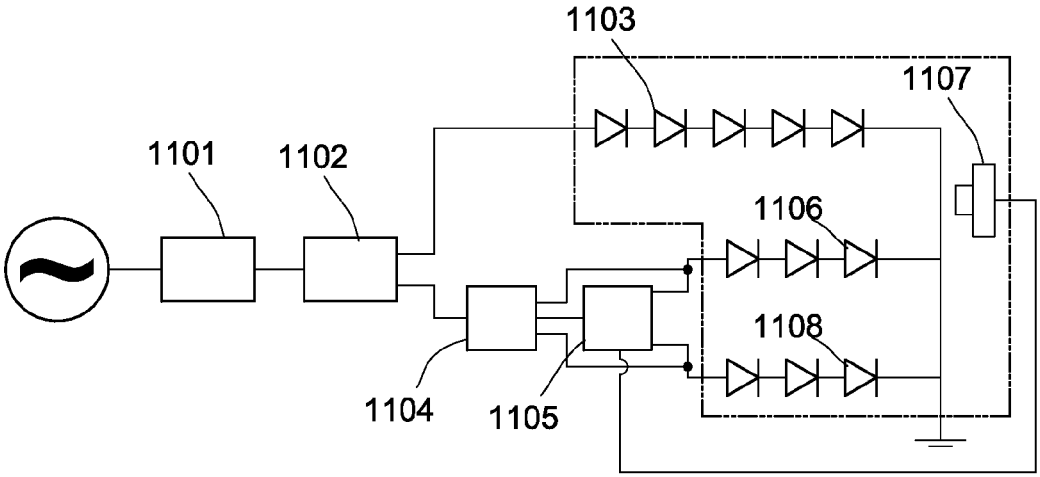
FIG. 10 illustrates a schematic block diagram of an electrical circuit for a luminaire according to an embodiment of the present invention.

According to another embodiment of the present invention, the lighting device comprises a combination of high power LEEs and smaller low power LEEs. The lighting device also comprises an AC-DC power converter. This may increase heat load over simpler purely rectifier-based circuit embodiments but can greatly reduce thermal stress and may simplify certain aspects of lighting device design. Small, inexpensive and efficient AC-DC power converters can be used to better control certain characteristics of the LEEs and the mixed light emitted by the lighting device. As is illustrated in FIG. 10, the majority of the light can be generated by white LEEs of desired CCT, for example warm white light LEEs, which can be interconnected in one or more strings. The white LEEs 1103 can be driven at fixed predetermined operating conditions for example via full wave rectified AC by rectifier 1101 and optionally smoothed drive voltages by smoothing components 1102 provided by a simple AC supply. The AC-DC converter 1104, which also may be provided by a combination of the rectifier 1101 and smoothing components 1102, is used to supply control and drive circuits 1105 for additional green 1108 and blue 1106 strings of LEEs, for example. Digitally controlled strings of blue and green LEEs operating at low currents are used to modify the chromaticity or CCT of the overall light output. This enables full control over the output of the green and blue string and allows the generation of white light with controllable CCT along the Planckian locus, or to generate light with other chromaticities within the gamut of the lighting device. For example, feedback may be provided by optical sensors 1107 which can provide feedback signals to a control device 1105, which based on the feedback signals can modify the current being supplied to the blue and green light-emitting elements.

Figure 11:
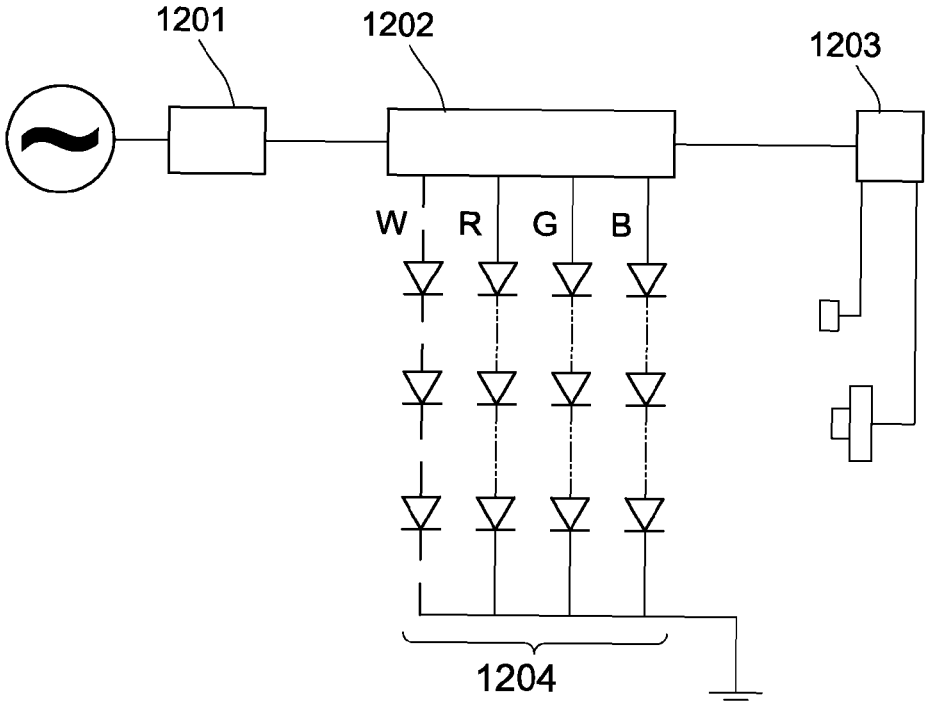
FIG. 11 illustrates a schematic block diagram of an electrical circuit for a lighting device according to another embodiment of the present invention.

As is illustrated in FIG. 11 and in accordance with another embodiment of the present invention, a lighting device can comprise a number of strings of LEEs 1204 which can be driven by a common DC voltage. The DC voltage can be provided by a rectified AC power supply voltage by the AC/DC converter 1201. Each string can have LEEs of its own nominal color and each string can have one or more LEEs. For example, the lighting device can comprise three or four strings, one of red, one of green, one of blue LEEs and optionally one of amber LEEs. Each string is operatively connected to one of three or four channels of a DC driver which can provide separately controllable drive currents per channel. The lighting device can also comprise a microprocessor for controlling the DC driver so that full color control of the mixed light can be achieved. An optical feedback system 1203 can optionally be included, which may include one or more of optical sensors, temperature sensors, voltage sensors, current sensors or other sensor as would be readily understood. It is noted that increasing the number of LEEs per string, while adequately matching the numbers of LEEs in the strings relative to each other, in order to provide the lighting device with a desired gamut, while driving the LEEs with an adequately higher voltage, may help reduce total current in certain components of the lighting device and consequently can improve efficiency of the lighting device.

Power Supply

Lighting device according to embodiments of the present invention can comprise a power supply or may be configured to operate with an external power supply. According to one embodiment of the present invention a luminaire can include an alternating current (AC) power supply that supplies AC current of a certain frequency and amplitude to directly drive a predetermined number of adequately configured LEEs. For example, the power supply may be configured to provide unrectified, or half or full rectified line voltage or other types or magnitudes of voltages to predetermined LEE interconnections. Lighting device according to other embodiments of the present invention may comprise switch-mode power supplies.

Simple types of power supplies may provide less control over operating conditions of LEEs and the light emitted by the LEEs such as chromaticity and intensity, for example, but may require no or relatively simple control circuits and may be suitable for certain types of applications. Corresponding lighting device may require larger numbers of LEEs, as forward voltages are typically a few volts only and nominal effective or peak line voltages can be of the order of one hundred to a few hundred volts. It may consequently be useful to employ relatively large numbers of small LEEs to simplify component lists and electrical requirements for power supplies and power distribution systems within a lighting device.

Optical System

Lighting devices according to various embodiments of the present invention may employ an optical system. The optical system can include one or more of each of reflective, refractive or transmissive elements in one or a number of configurations. For example, the optical system can include one or a combination of reflective coatings, reflective surfaces, diffusers, lenses, and lenticular elements and so forth as would be readily understood by a worker skilled in the art. For example, certain components of the lighting device can be configured, for example shaped or treated or both, to provide desired reflection or refraction of light that is generated by the LEEs under operating conditions and redirect the light towards a surface in order to illuminate the surface in an intended way.

The optical system and its components can redirect or refract light or assist mixing of light in one embodiment. Reflective coatings, for example, can be made of a glossy white finely foamed plastic such as microcellular polyethylene terephthalate (MCPET). Reflective coatings can be disposed on substrates or other components of the optical system or the luminaire.

Embodiments of the present invention can comprise one or more diffusers or diffusive elements or elements that provide, among other functions, a diffusing function. Diffusers can be employed in lighting device to provide intended illumination, colour mixing or beam spreading, for example.

It is noted that luminaries according to embodiments of the present invention can be configured in a modular way so that lighting device can be combined with other systems or components of the lighting device can be readily replaced or exchanged in a modular way. Lighting devices according to the present invention can furthermore be configured to be compact and can be used in a plurality of illumination applications or combined with a plurality of decorative components to achieve a plurality of lighting device designs.

Lighting device according to the present invention can be configured for use in energy-saving applications. They can also be configured to provide simple configurations with few parts and save energy and cost required for manufacturing.

The invention will now be described with reference to particular examples. It will be understood that the following examples are intended to describe embodiments of the invention and are not intended to limit the invention in any way.

EXAMPLES

Example 1

An example lighting device according to one embodiment of the present invention provides light of predetermined correlated colour temperature (CCT) or predetermined intensity or both. This example lighting device does not employ a sophisticated CCT or intensity control system with optical or thermal feedback sensors. It is noted that lighting device according to other embodiments of the present invention may include corresponding control systems.

Referring again to FIG. 1, in one embodiment, lighting device includes a housing comprising heat spreading chassis 310 thermally connected to exterior cooling fins 315 or other exterior surface-increasing elements to improve air convection. The chassis can be configured in various forms, including linear, curved, or curvilinear and may have cylindrical or prismatic inside surfaces and it can have an elliptical or regular or irregular polygonal shaped cross sections. It is noted that polygonal and elliptical cross sections can improve mixing of light emitted by LEEs from different positions within the lighting device. The inside surface of the heat spreading chassis can have a groove 320 or other mounting means for disposing a thermally conductive substrate 330 containing LEEs therein. The substrate can be flexible and thermally conductive. An adequately flexible substrate can be resiliently biased into the groove or other mounting means. Alternatively, the substrate can be disposed and held in place using a spring mechanism which can resiliently bias the substrate against another suitable component of the lighting device.

The mechanical connection with the groove or the one or more similar elements can also provide good thermal conductivity with the housing. The substrate can support a number and color of LEEs, for example blue or UV LEEs. The substrate may comprise or consist essentially of high thermal conductivity beryllium copper alloys or other equivalent materials to provide the spring mechanism. The substrate carries several tens of LEEs connected in series. The exact number of LEEs depends on the forward voltages of each of the LEE, the line voltage and the desired drive LEE current. The substrate can be optionally configured or integrated into a modular component which can be easily replaced if, for example, the substrate or an LEE fails. Rather than replacing the whole lighting device, the substrate with its LEEs can be replaced. The spring loaded feature will provide good thermal contact for heat dissipation. Electrical contact is made with screw type connections of a variety of forms, or also spring loaded mechanisms.

The lighting device can also comprise optical elements such as a rotationally symmetric reflector that redirect the light emitted by the LEEs towards the exit aperture. Optionally, the lighting device comprises optically refractive elements, such as one or more lenses, or a diffuser plate proximate to the exit aperture. The diffuser plate can comprise a photoluminescent material such as a phosphor, for converting at least a portion of the blue or UV light emitted by the LEEs into light of longer wavelengths, for example yellow light. The diffuser plate mixes the light which originates from the LEEs and in combination with the photoluminescent material can determine the chromaticity or CCT of the overall mixed light emitted by the lighting device. Consequently, the lighting device can provide white light with a predetermined chromaticity. The CCT is determined also by the wavelengths of the light emitted by the LEEs and the type or types of phosphor used. The reflector or the LEEs can alternatively or additionally comprise photoluminescent material.

The photoluminescent material can be used to suppress otherwise perceivable flicker, and, to a certain degree, color variations, which may be caused by drive voltages with low frequency ripple, for example. Intensity variations of the light generated by the LEEs can be significantly reduced by photoconverting the light emitted by the LEEs with a photoluminescent material that provides adequate luminescence or decay time. The photoluminescent material can then provide sufficient light to bridge brief periods during which LEEs may emit less or even no light. As is known, photoluminescent materials or phosphors are used in many other applications such as in cathode ray tubes (CRTs) and some types of fluorescent light sources and are typically designed to provide decay times of about 10 ms. It is noted that rectified 60 Hz line voltage obtained from a simple rectifier circuit will contain remnant ripple of predominantly 120 Hz and higher frequencies. Further suppression of perceivable flicker can be achieved with improved rectifier circuits which may, however, produce additional heat and affect thermal load of the lighting device.

Alternatively, strings of LEEs in a lighting device can be directly supplied with AC voltage. For example, an even number of strings can be employed and half of the strings can connected with the other half in an anti-parallel fashion. Either half will only be activated and emit light during at most one of the half-waves while remaining off during the other half wave of the line voltage. This may help, subject to proper mitigation of thermally induced stress, to extend the lifetime of the lighting device.

FIG. 2, also referenced above, illustrates another embodiment of the present invention. The LEEs can be arranged on one or more substrates which can be resiliently biased against the inside of the lighting device. The LEEs can be arranged in such a way that they align in rings around an axis of a reflector. The reflector can be integrally shaped and can have an adequately curved profile with, for example, a set of adequately curved sections, with each section corresponding to one ring. The lighting device may comprise LEEs of one or more nominally different colors or center wavelengths including red, amber, green, cyan, blue or different UVs, or a combination of two or more of these or other colors or center wavelengths such as blue and UV.

A lighting device according to another embodiment of the present invention can provide fixed or adjustable colored light. The lighting device can comprise one or more strings of LEE and different strings can have different color LEEs. For example, the lighting device can have one string of red, one string of green and one string of blue (RGB) LEEs. Optionally strings of amber or cyan or both color LEEs can be included in the lighting device. As is well known, a multi-color light sources based luminaire can be configured to emit mixed light with chromaticities or CCTs within the gamut defined by the chromaticities of its multi-color light sources.

According to this embodiment, each string in the lighting device is interdependently driven by a full wave rectified AC power source derived from a single phase power supply. The drive current for each string depends is set in accordance with the desired color or CCT of the mixed light. As is illustrated in FIG. 9, the drive currents which are supplied to each LEE string can be phase shifted relative to each other in order to reduce undesired perceivable flicker. It is noted that respective phase-shifting techniques and electronic circuits are widely known in the art.

For example, in an RGB system, the red drive voltage can lag relative to the green waveform, and the green drive voltage can lag the blue waveform. It is noted that the respective lags may be nominally the same or they may be different. Also, the drive voltages may be equally or otherwise distributed over time. The drive voltages may optionally be filtered or smoothed. The amount of light emitted by the LEEs in a string or the drive currents per string can be controlled by a control system separately or interdependently from other strings. Optical or thermal or both types of feedback sensors may be optionally included in the luminaire. The sensors can provide signals to the control system which can be used in a closed loop control configuration to have the lighting device emit mixed light of desired chromaticity and intensity.

The lighting device may optionally comprise an optical sensor for a suitably configured control system for monitoring the mixed light and for providing a feedback signal to the control system. The control system can ensure that the chromaticity and intensity of the light emitted by the lighting device remain as desired based on readings of the optical sensor signal.

Example 2

FIG. 3 schematically illustrates white LEEs positioned on a heat sink in the middle or on an inside surface of a rear wall of the lighting device. A heat pipe may be used to transfer the excess heat produced by these LEEs towards the outside of the lighting device and further on to, for example, exterior heat dissipating fins. The blue and green LEEs are located around the inner curved surface of the housing. They may be mounted on resiliently biased flexible substrates. The substrates are thermally well conducting. The number of white LEEs may be significantly higher, for example, five to ten times, than the number of blue or green LEEs.

Figure 12:
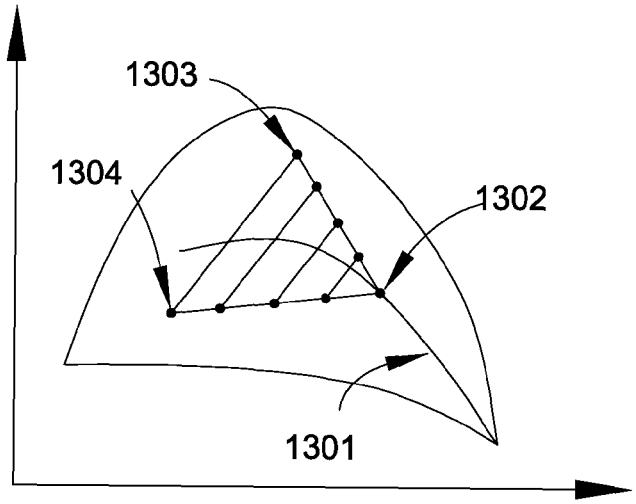
FIG. 12 schematically illustrates a chromaticity diagram with chromaticity coordinates of a number of light sources.

According to another embodiment of the present invention, the lighting device comprises a combination of high power LEEs and smaller low power LEEs. The lighting device also comprises an AC-DC power converter. This may increase heat load over simpler purely rectifier circuit based embodiments but can greatly reduce thermal stress and may simplify certain aspects of lighting device design. Small, inexpensive and efficient AC-DC power converters can be used to better control certain characteristics of the LEEs and the mixed light emitted by the lighting device. As is illustrated in FIG. 12, the majority of the light can be generated by white LEEs of desired CCT, for example warm white light LEEs, which can be interconnected in one or more strings. The white LEEs can be driven at fixed predetermined operating conditions for example via full wave rectified and optionally smoothed drive voltages provided by a simple AC supply. The AC-DC converter is used to supply control and drive circuits for additional green and blue strings of LEEs, for example. Digitally controlled strings of blue and green LEEs operating at low currents are used to modify the chromaticity or CCT of the overall light output. This enables full control over the output of the green and blue string and allows the generation of white light with controllable CCT along the Planckian locus, or to generate light with other chromaticities within the gamut of the lighting device as illustrated in the chromaticity diagram of FIG. 12.

The chromaticity diagram of FIG. 12 shows the coordinates 1302 of the white LEEs used to provide the majority of the light intensity. The coordinates of the blue 1304 and green 1303 LEEs are at the other two vertices of the triangle. A portion of the Planckian locus 1301 lies inside the exemplified gamut, which indicates that the controllable color temperature is in the range 2700K-4100K. White, blue and green LEEs with other chromaticity coordinates can be used to obtain other CCT ranges.

Example 3

Figure 13:
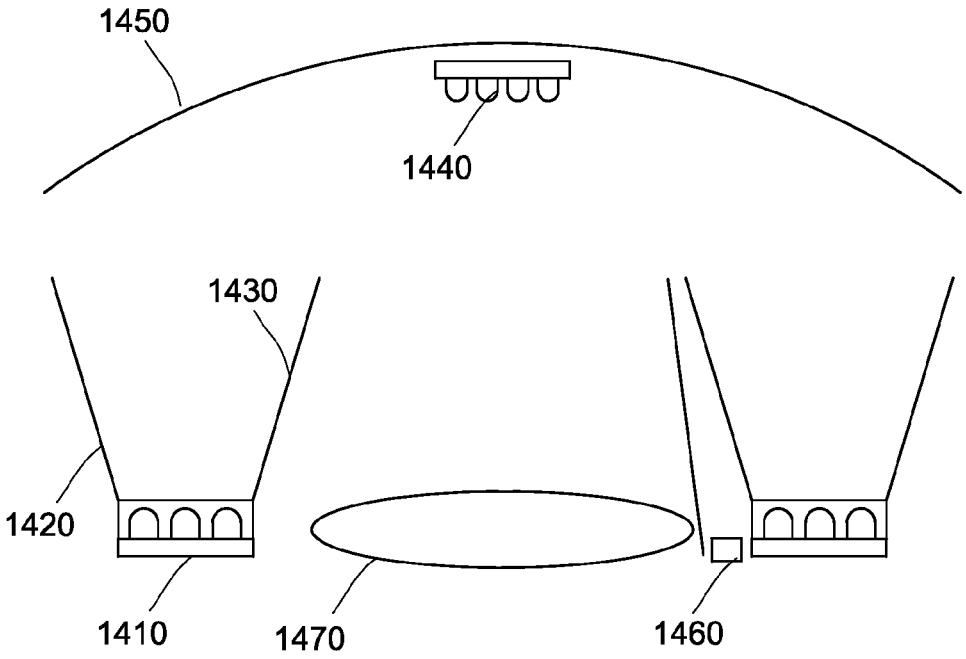
FIG. 13 schematically illustrates a cross section of an embodiment of a lighting device.

According to yet another embodiment of the present invention and as illustrated in FIG. 13, a lighting device can comprise a ring of blue or white LEEs 1410, with beam conditioning components 1420 and 1430 which can comprise reflective surfaces with predetermined surface textures. Optionally, for example, red and green LEEs 1440 can be used to control the CCT of the emitted light. The reflector 1450 can be optionally coated with a photoluminescent material such as certain phosphors, for example. Optional optical sensor 1460 can be operatively connected to an optional control system and can be used to sense light and provide certain information about the light for processing to the control system. Optical elements 1470 can be used to achieve desired beam collimation and illumination.

Figure 14:
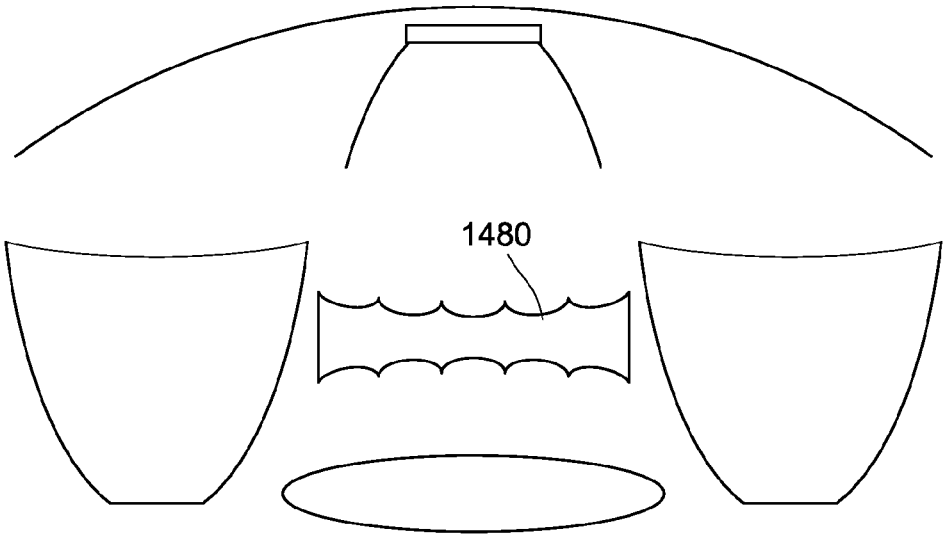
FIG. 14 schematically illustrates a cross section of another embodiment of a lighting device.
Figure 15A:
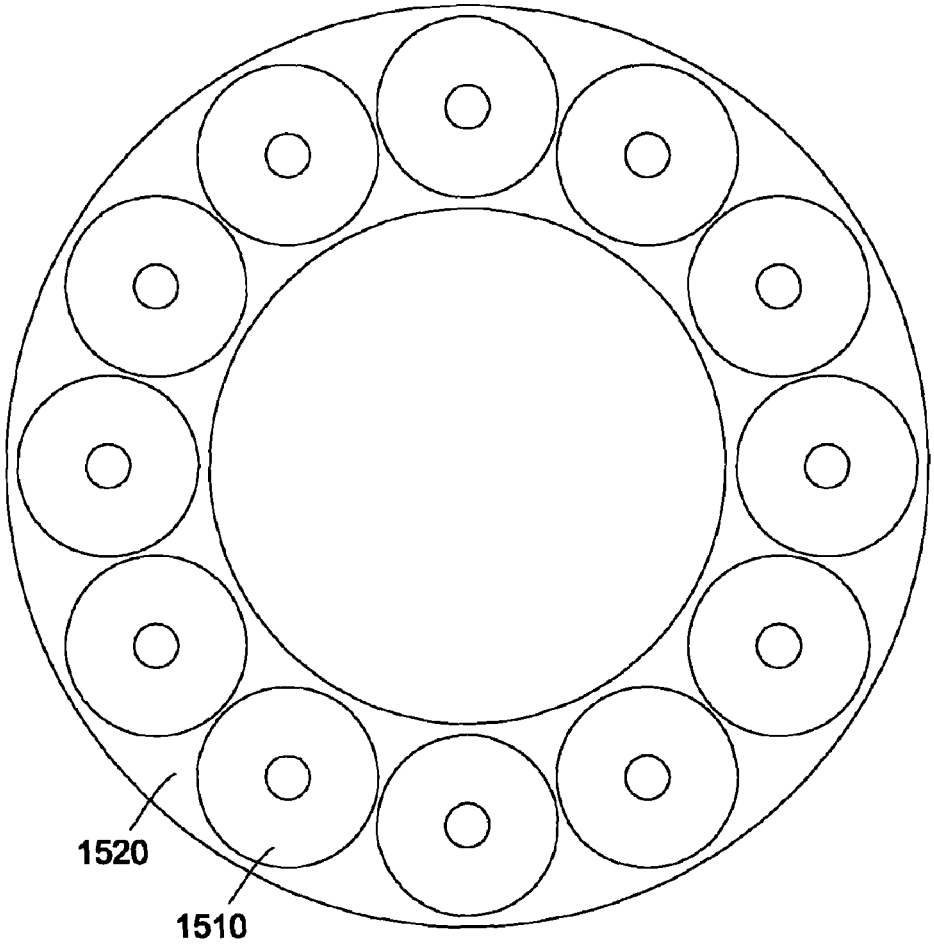
FIGS. 15A and 15B schematically illustrate top and sectional views, respectively, of a partial parabolic compound concentrator according to one embodiment of the present invention.
Figure 15B:
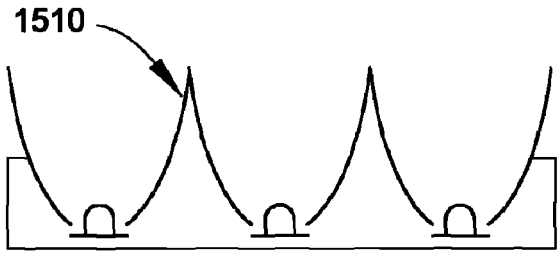

FIG. 14 illustrates a lighting device similar to that as illustrated in FIG. 13, further including an optional refractive element 1480 positioned below the red and green LEEs. The optical components can form a compound parabolic concentrator (CPC). FIGS. 15A and 15B illustrate how multiple CPC components 1510, when disposed in a ring 1520, can form partial CPCs that can be used to improve light mixing.

Example 4

Figure 16:
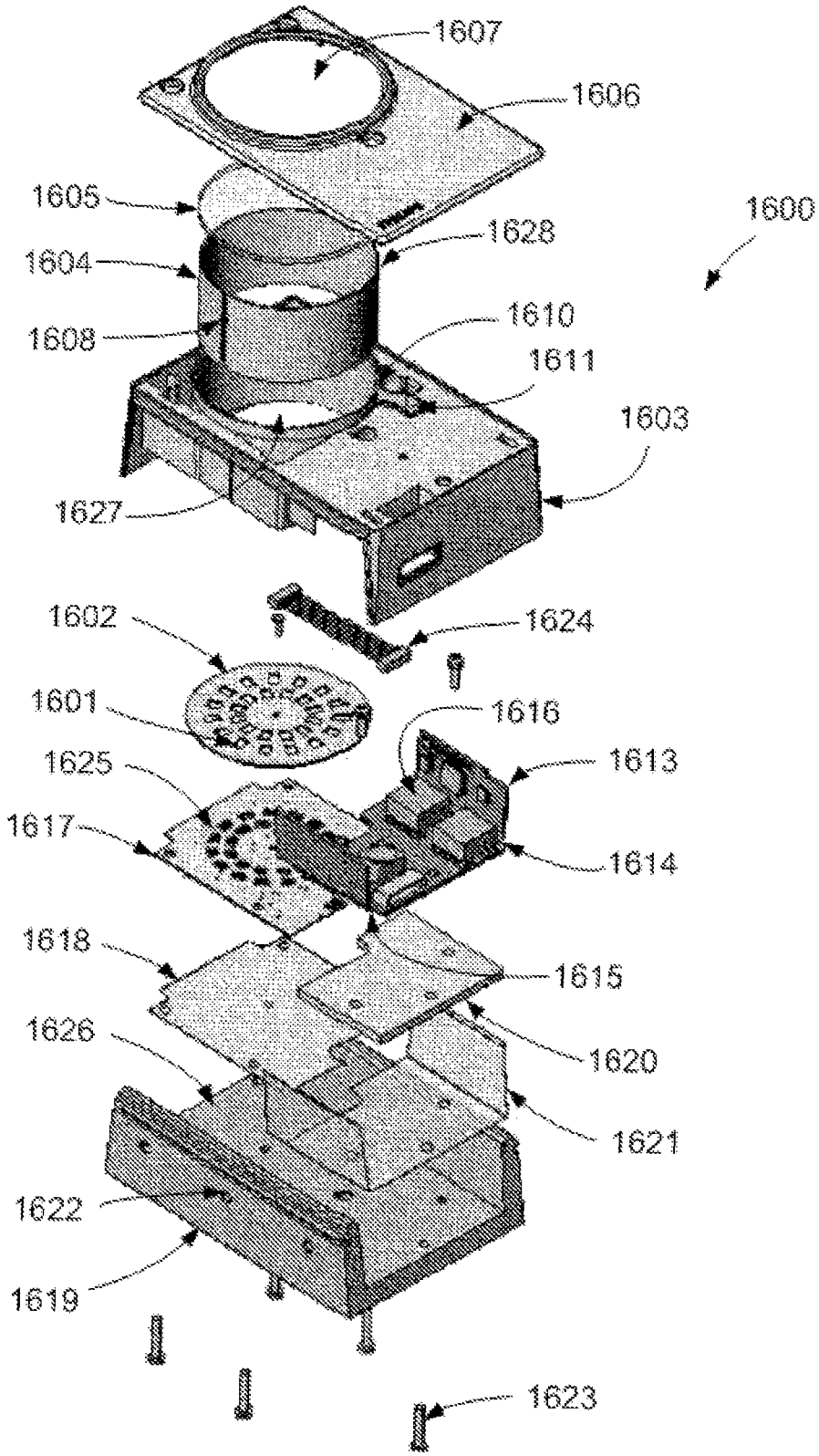
FIG. 16 illustrates an exploded view of an example lighting device according to an embodiment of the present invention.

FIG. 16 illustrates an exploded view of yet another exemplary lighting device 1600 according to some embodiments of the present invention. The lighting device includes LEEs 1625 mounted in a circular arrangement on a LEE circuit board 1617. A reflector disc 1602 of MCPET with cut out holes 1601 corresponding to the positions of the LEEs is disposed on the LEE circuit board 1617 such that the upper surfaces of the LEEs are visible through the holes. The reflective surface of the reflector disc faces upwards. The LEE circuit board can be made of a thermally well conductive material to allow for good heat spreading of the heat dissipated by the LEEs under operating conditions. The LEE circuit board is operatively connected to a thermally conductive but electrically insulating thin layer of a thermally conductive material 1618, which in turn is in contact with the inner surface 1626 of the heat spreading chassis 1619. Thermally conductive material can provide good thermal contact between it and the substrate and the chassis and also can provide good thermal conductivity within itself.

The drive circuit for the control system comprises various electronic components 1616, for example, and is operatively disposed on a folded printed circuit board 1613. The drive circuit board 1613 is folded along grooves 1614 and 1615. The drive circuit board 1613 can be operatively disposed and mounted on an electrically insulating, thermally conductive and optionally cushioning layer 1620. The sides and optionally the base of drive circuit board 1613 are electrically insulated from the chassis with a thin layer 1621 of electrical insulating material, such as MYLAR, other polyester or other suitable material, for example.

Figure 17A:
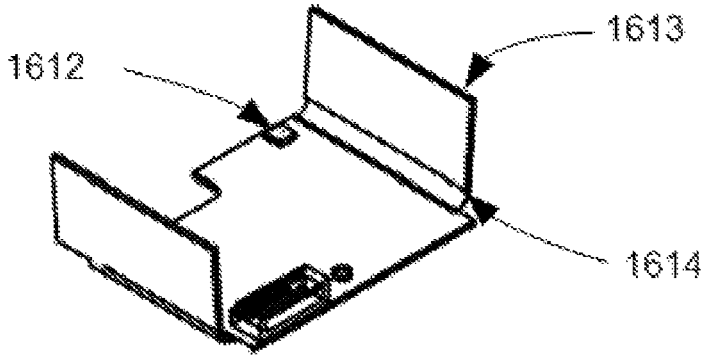
FIG. 17A illustrates a perspective view of a folded example drive circuit board according to an embodiment of the present invention.
Figure 17B:
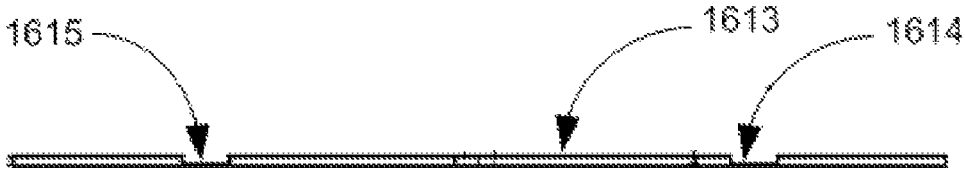
FIG. 17B illustrates a cross section of an exemplary drive circuit board according to an embodiment of the present invention.
Figure 17C:
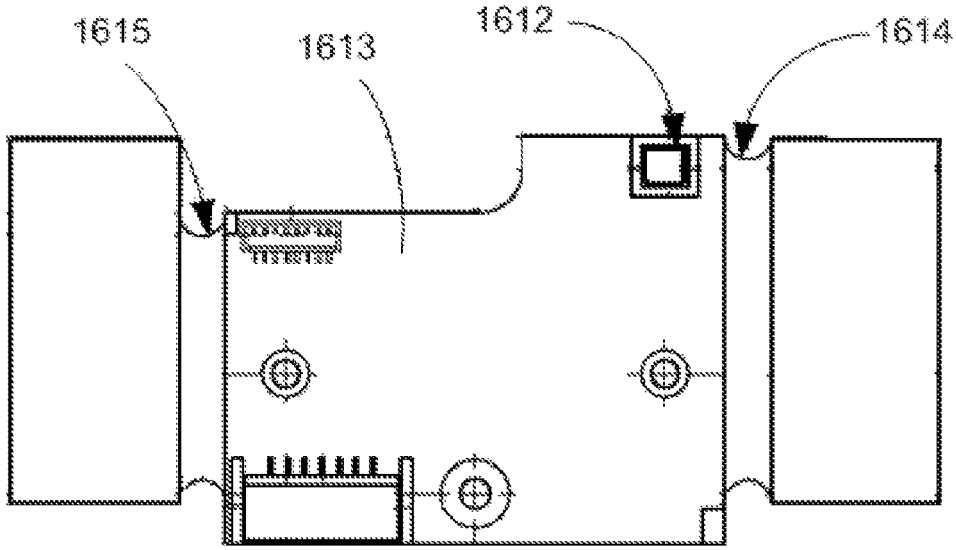
FIG. 17C illustrates a top view of an exemplary drive circuit board according to an embodiment of the present invention.

Devices and other components of the drive circuit are disposed on the drive circuit board 1613 so that they do not interfere with each other in the folded configuration. The drive circuit board is illustrated (not including devices) in a folded configuration in a perspective view in FIG. 17A, and in unfolded views in cross section in FIG. 17B and in a top view in FIG. 17C. The drive circuit board 1613 includes an optical sensor 1612.

The drive circuit is operatively connected to the LEEs via a flexible connector 1624. Optionally, the drive circuit board may be connected to the LEE circuit board using a direct board-to-board style connector. The chassis 1619 forms part of the housing of the lighting device and has numerous fixing points 1622 for attachment of external heat sinks (not illustrated) including passive or active cooled finned heat sinks, for example. External heat sinks may be additionally cooled by forced air cooling for improved convection, for example, or other ways of cooling as would be readily understood by a person skilled in the art. Screws 1623 attach the LEE circuit board 1617 and the drive circuit board 1613 to the chassis.

Figure 18A:
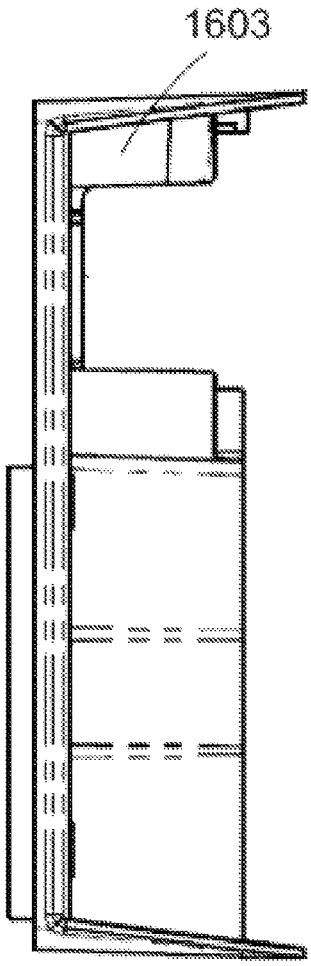
FIG. 18A illustrates a side view of a part of an exemplary housing of an lighting device according to one embodiment of the present invention.
Figure 18B:
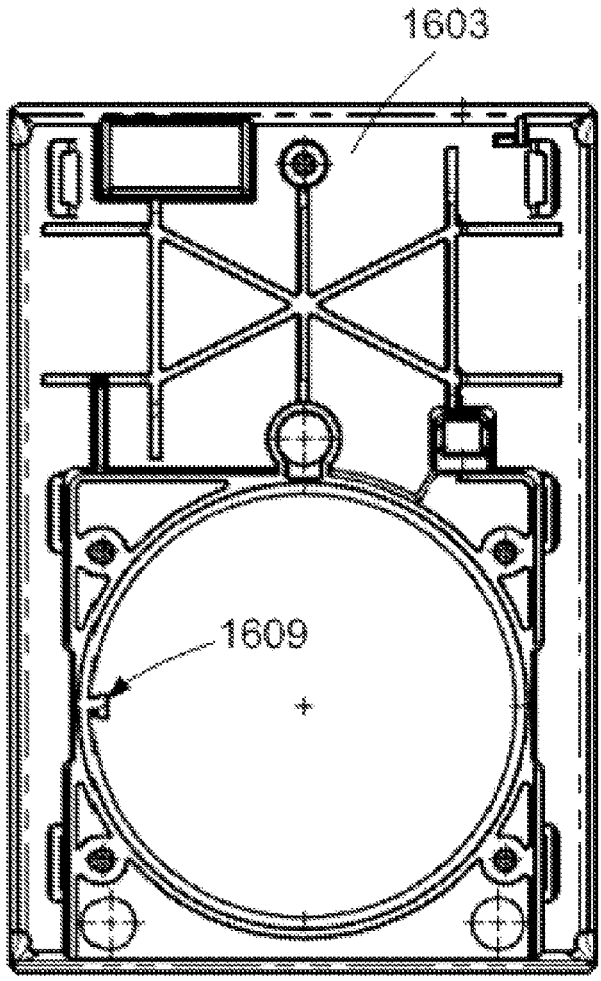
FIG. 18B illustrates a front view of a part of an exemplary housing of an lighting device according to another embodiment of the present invention.
Figure 18C:
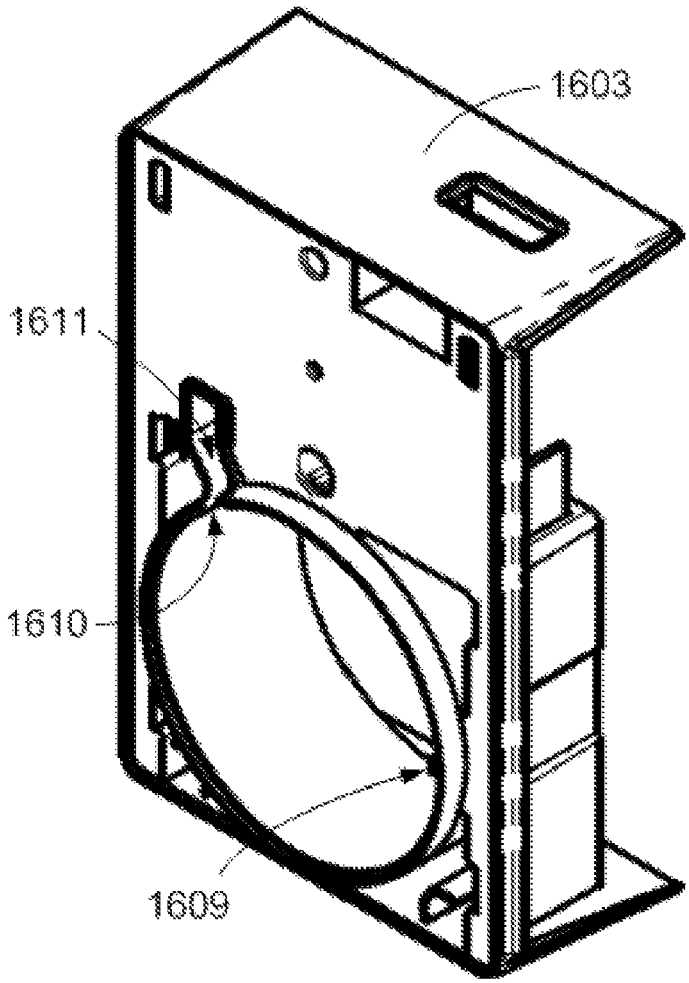
FIG. 18C illustrates a perspective view of a part of an exemplary housing of an lighting device according to still another embodiment of the present invention.

The upper part 1603 of the housing can be made of a suitable plastic, for example. The upper part of the housing is also illustrated in a side view in FIG. 18A, in a front view in FIG. 18B, and in a perspective view in FIG. 18C. The upper part defines a cylindrical cavity 1627 which can substantially align coaxially with the arrangement of LEEs in the assembled configuration. A material with reflective surface 1604 can be used to line the inside of the cylindrical cavity, thereby forming the mixing chamber for the lighting device. For example, MCPET or another suitable material can be disposed directly onto the inside of the cylindrical cavity or resiliently disposed in form of a flexible strip.

Figure 19:
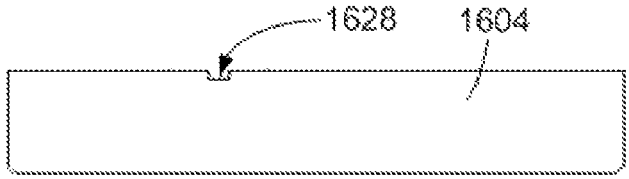
FIG. 19 illustrates a top view of an example strip of an exemplary optical system of a lighting device according to some embodiments of the present invention.
Figure 20:
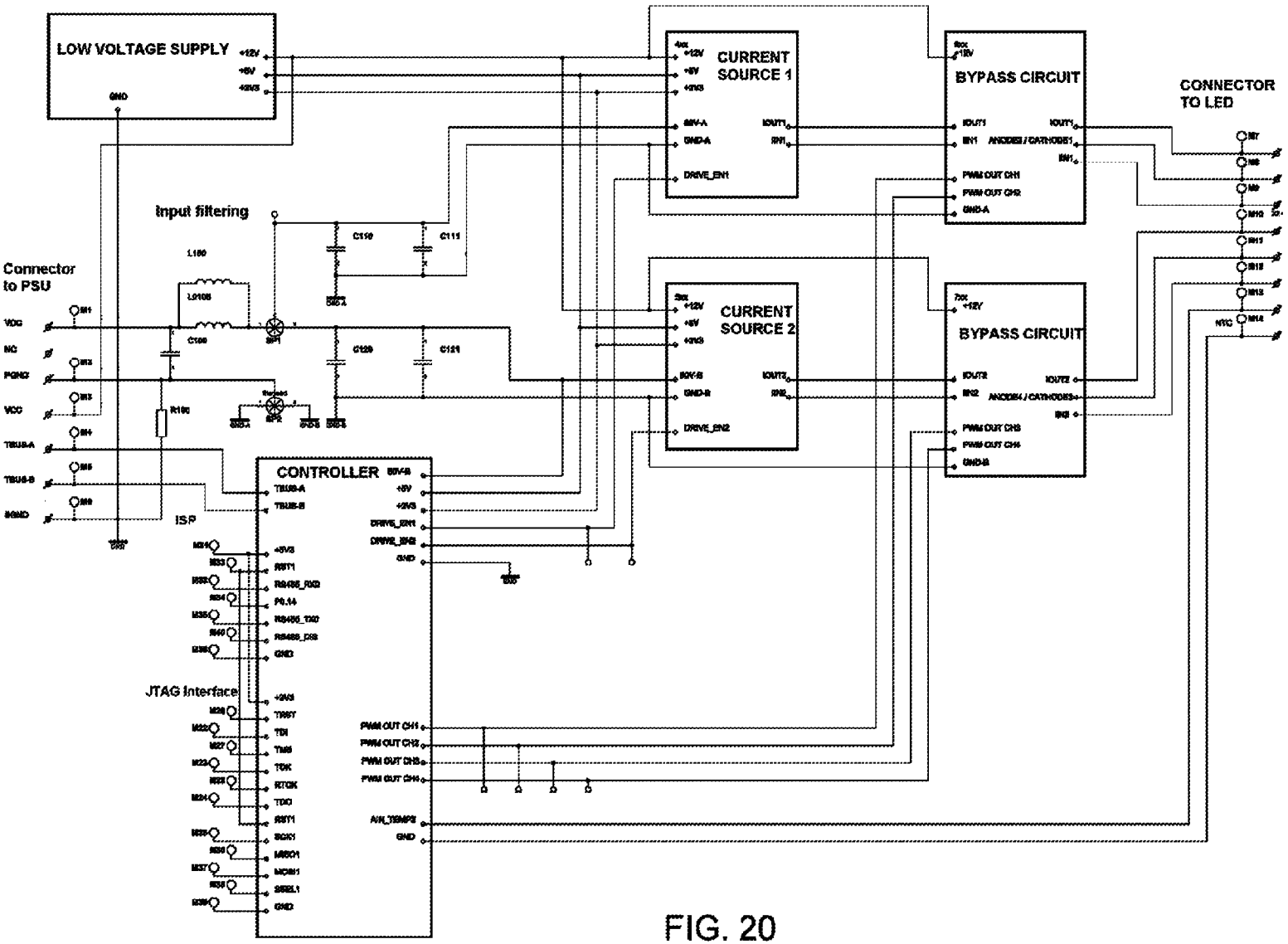
FIGS. 20 to 26 illustrate schematics of another example control system including a drive circuit of a lighting device according to some embodiments of the present invention
Figure 21:
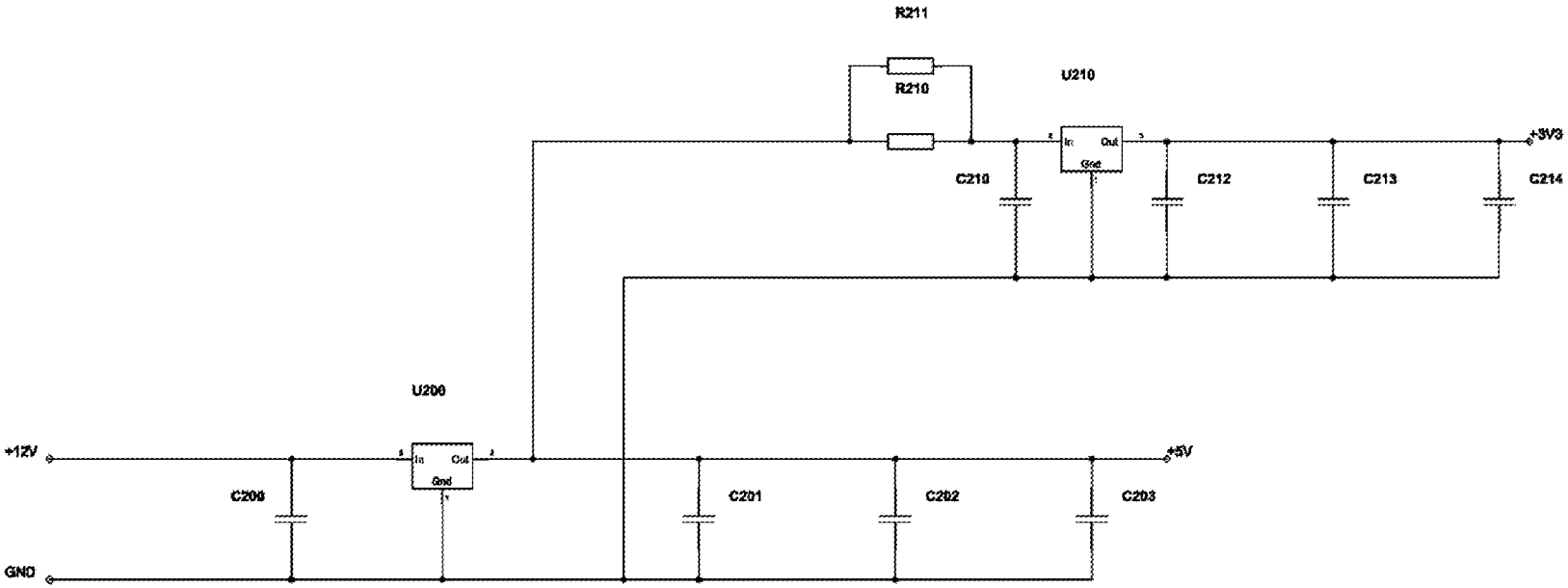
Figure 22A:
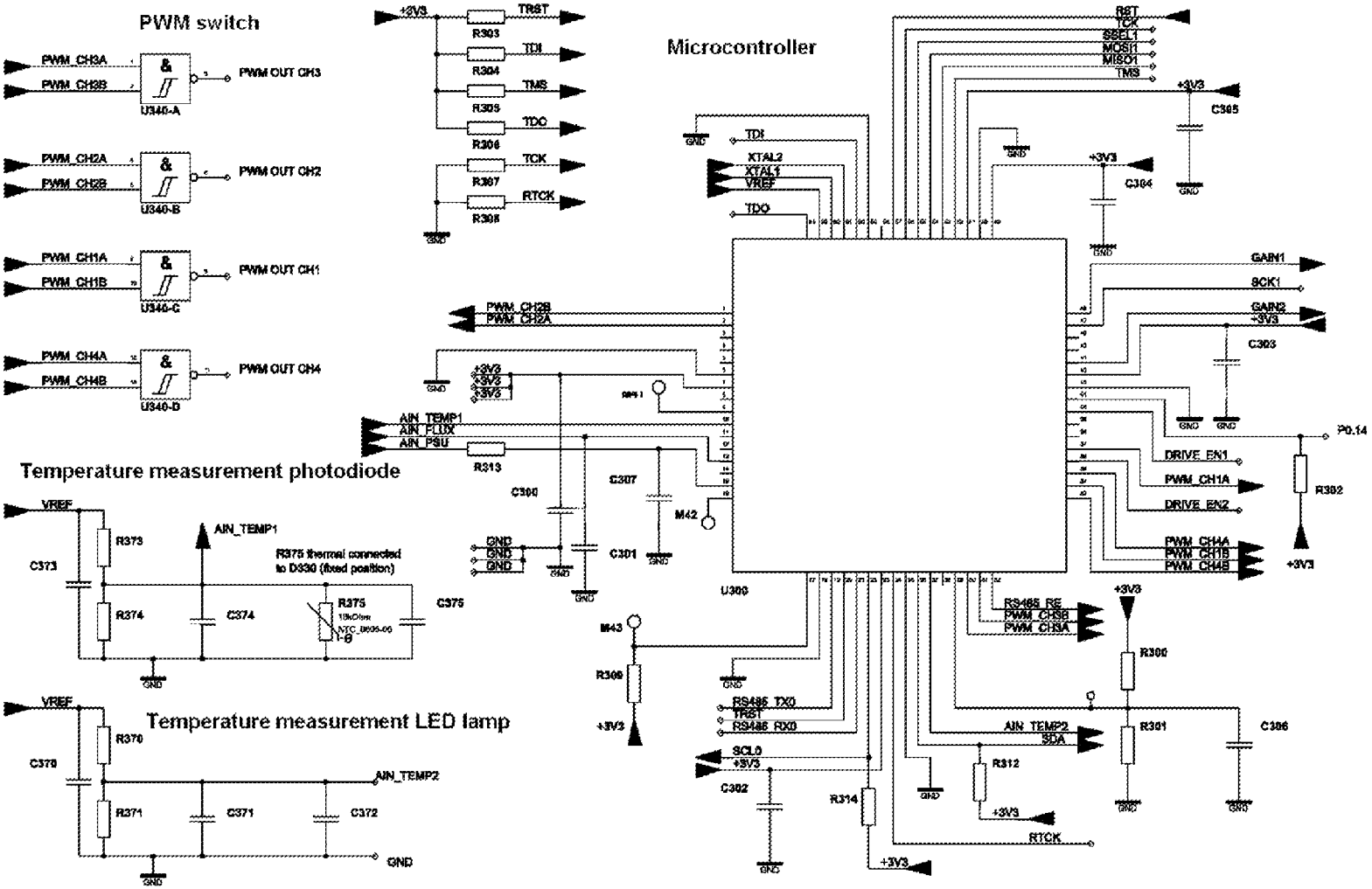
Figure 22B:
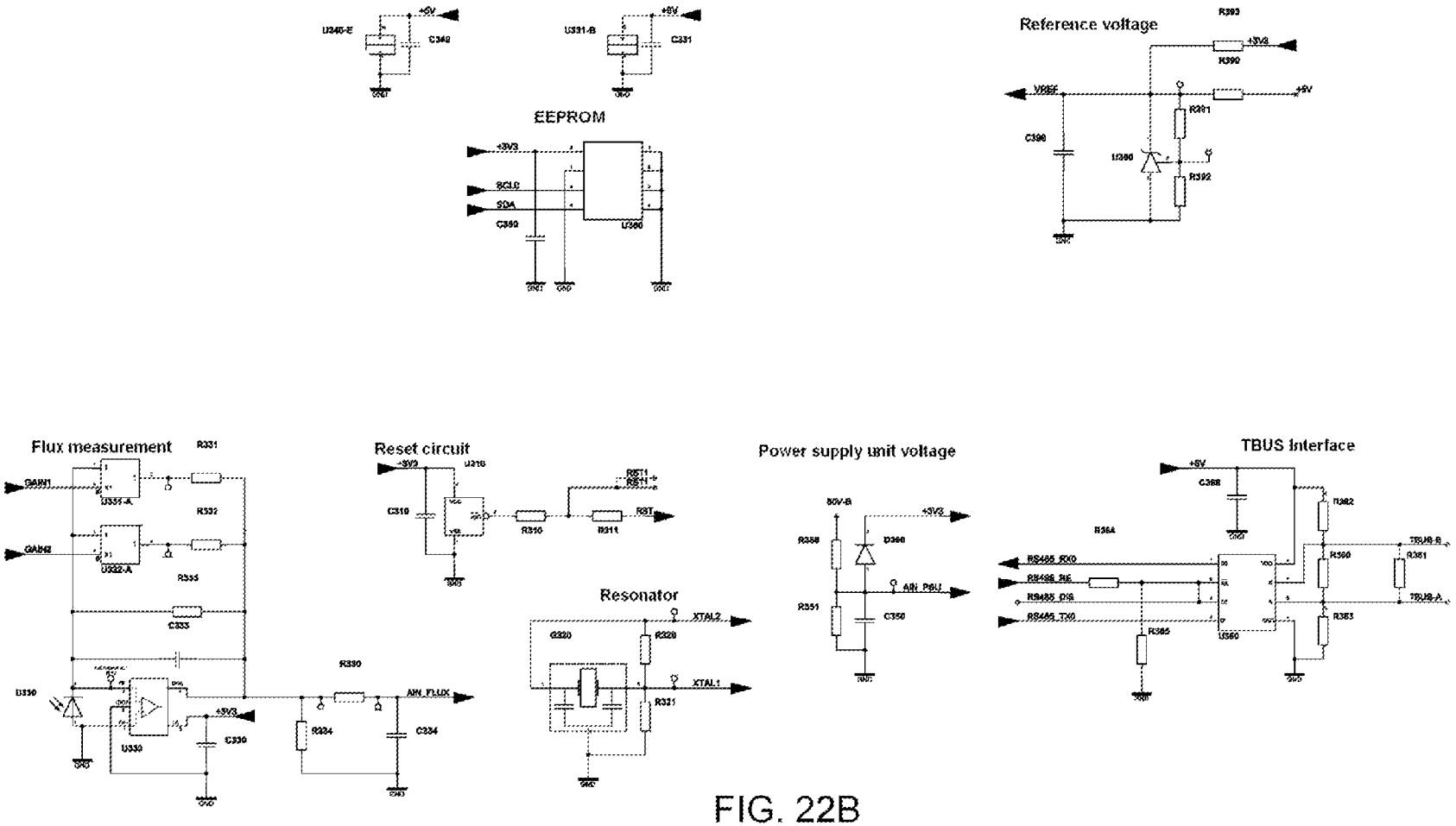
Figure 23:
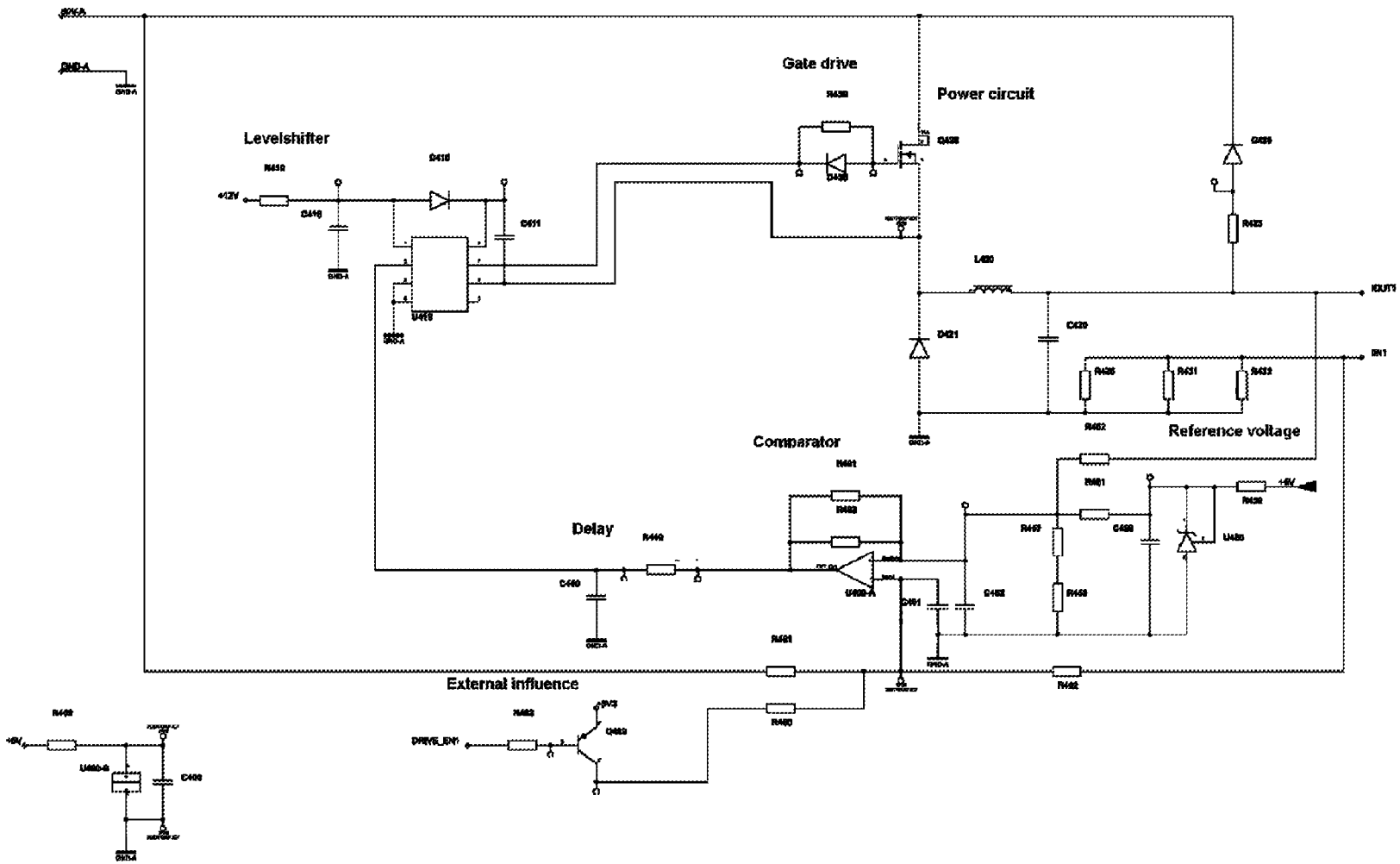
Figure 24:
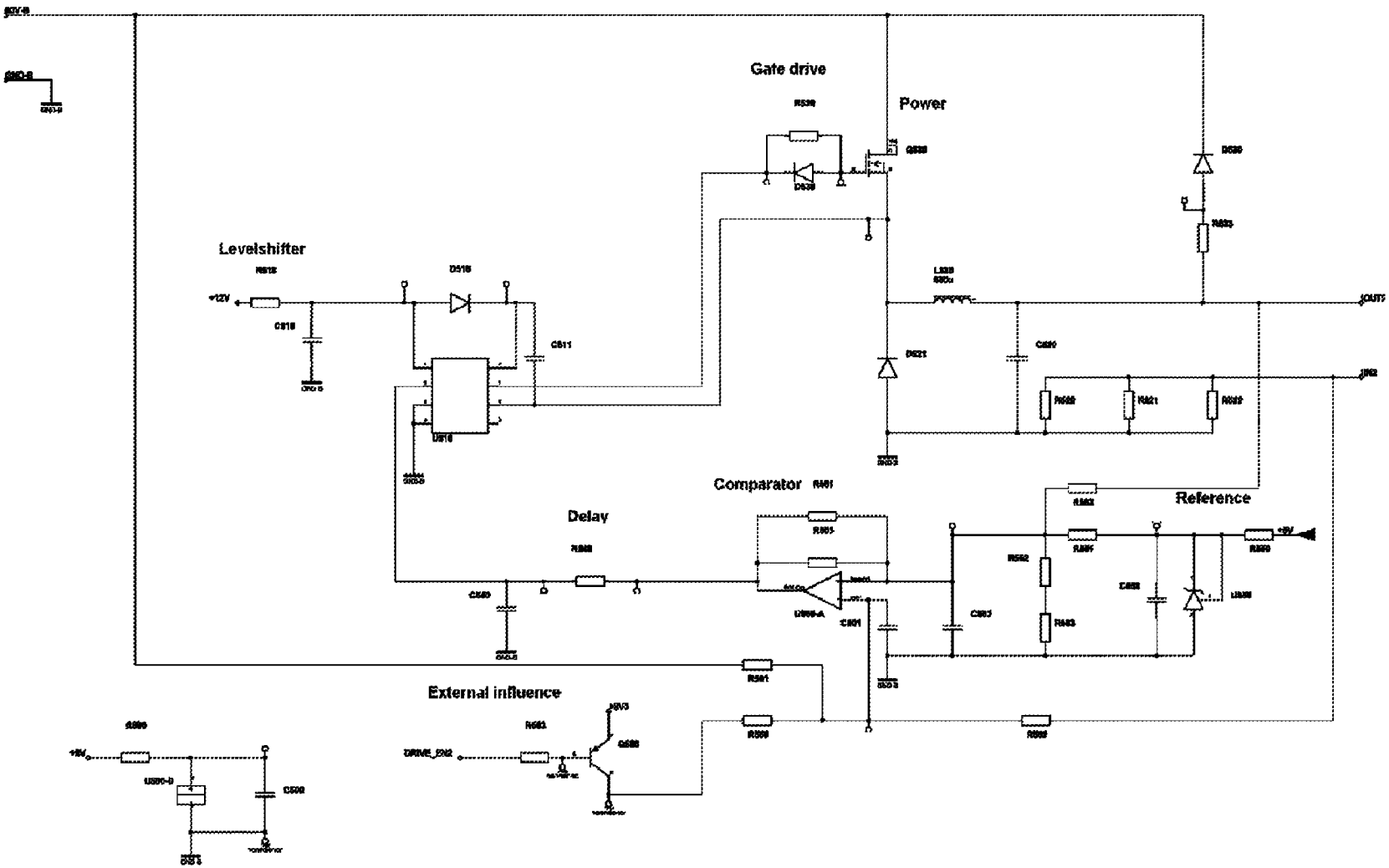
Figure 25:
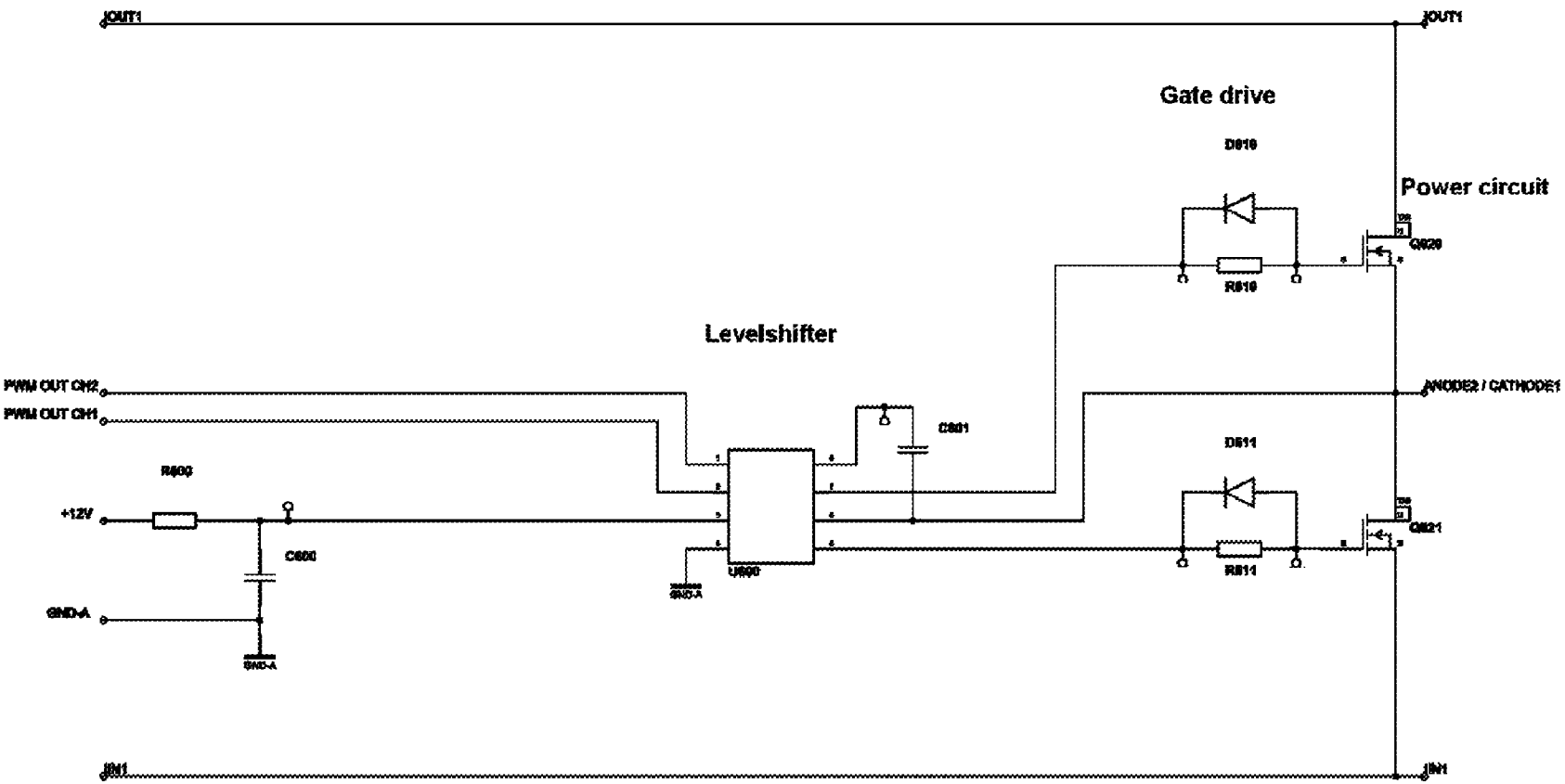
Figure 26:
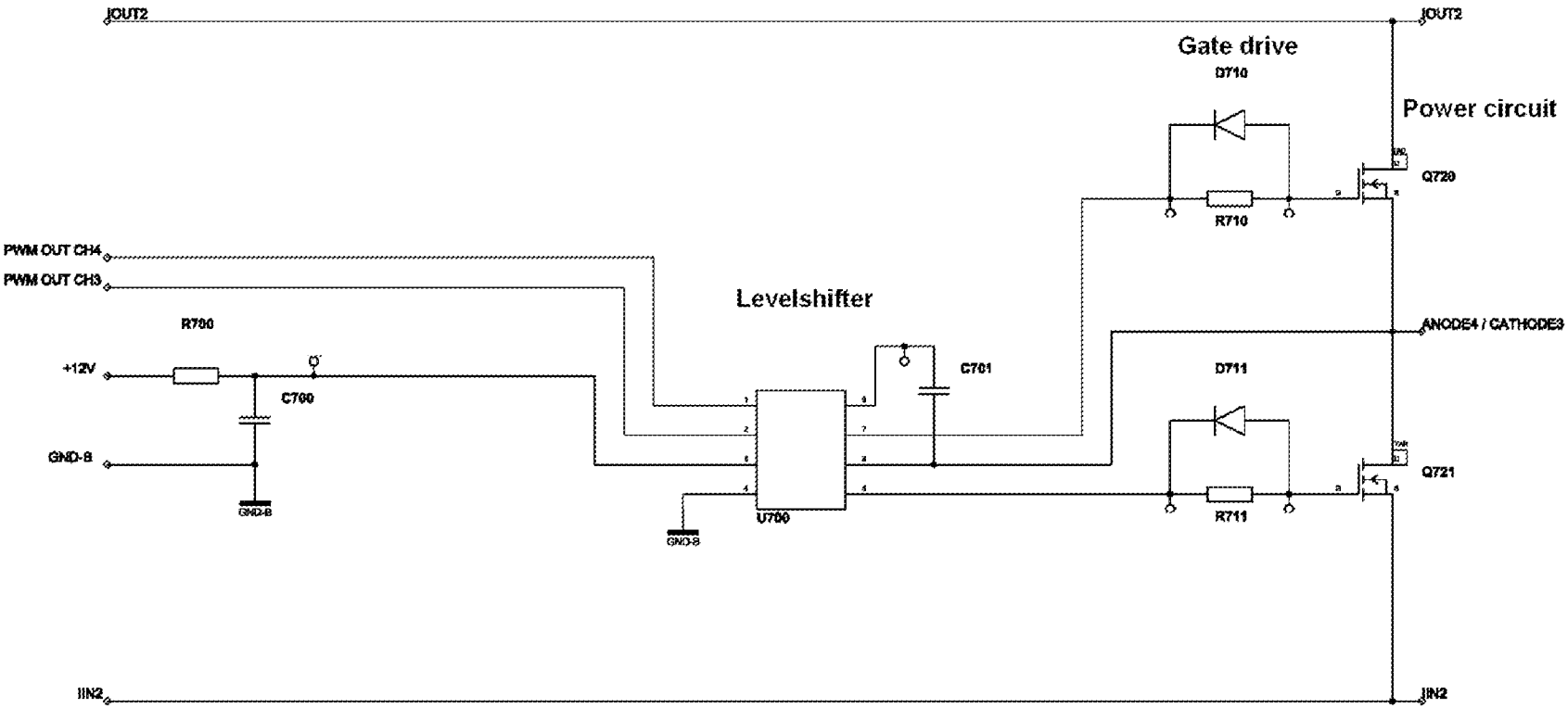
Figure 27:
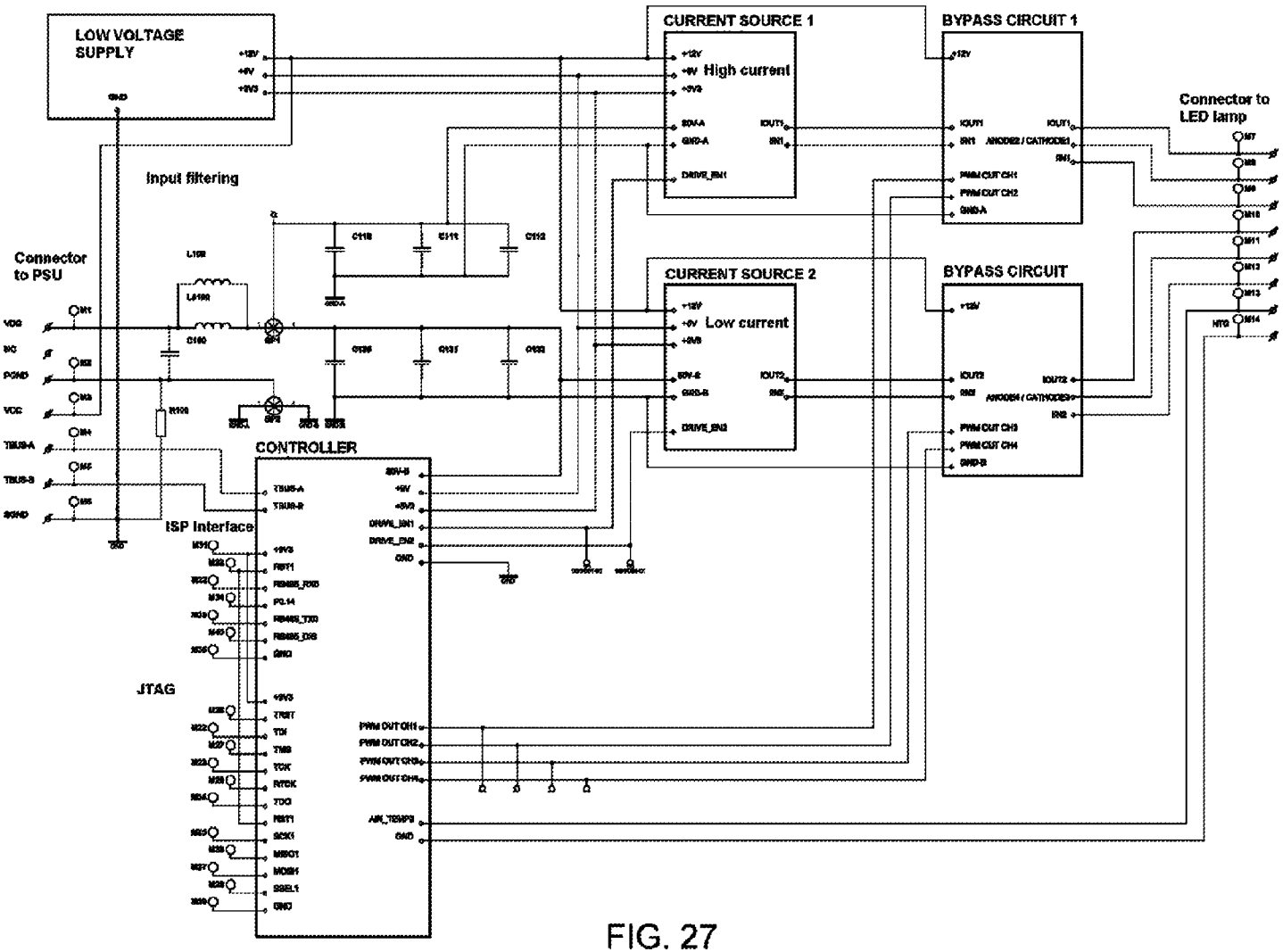
FIGS. 27 to 33 illustrate schematics of another example control system including a drive circuit of a lighting device according to other embodiments of the present invention
Figure 28:
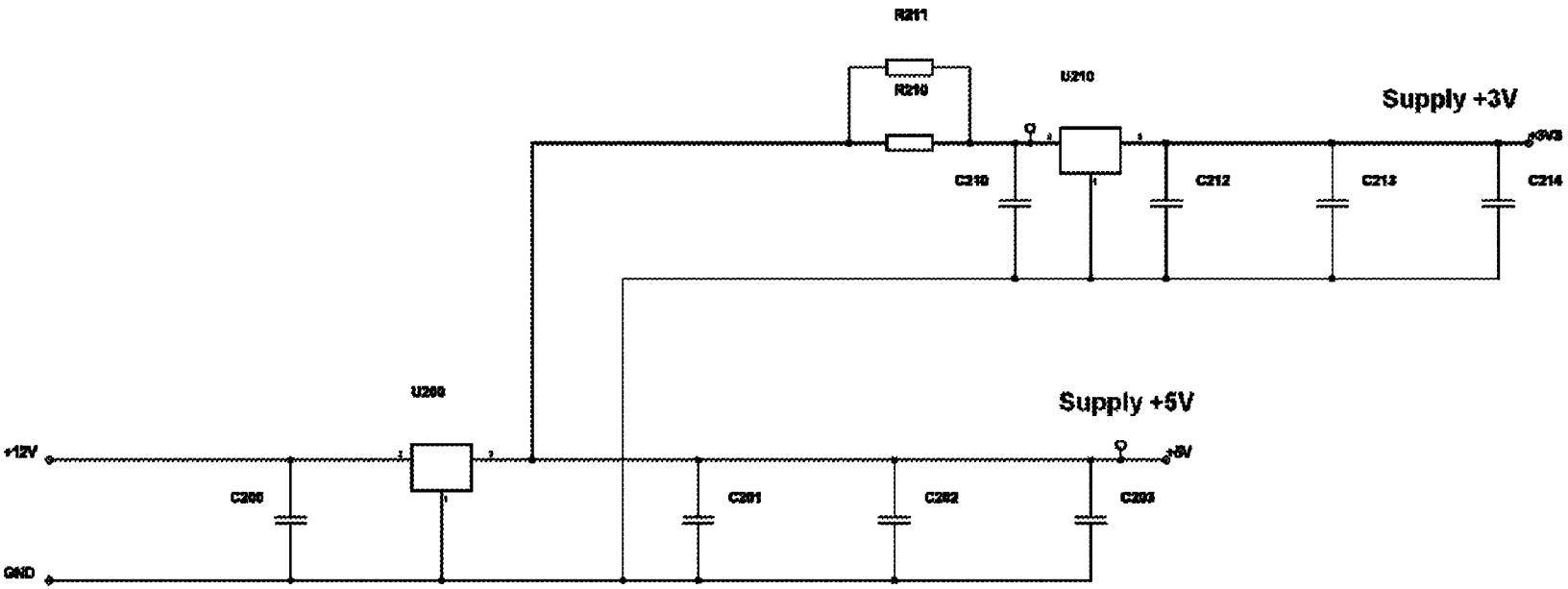
Figure 29A:
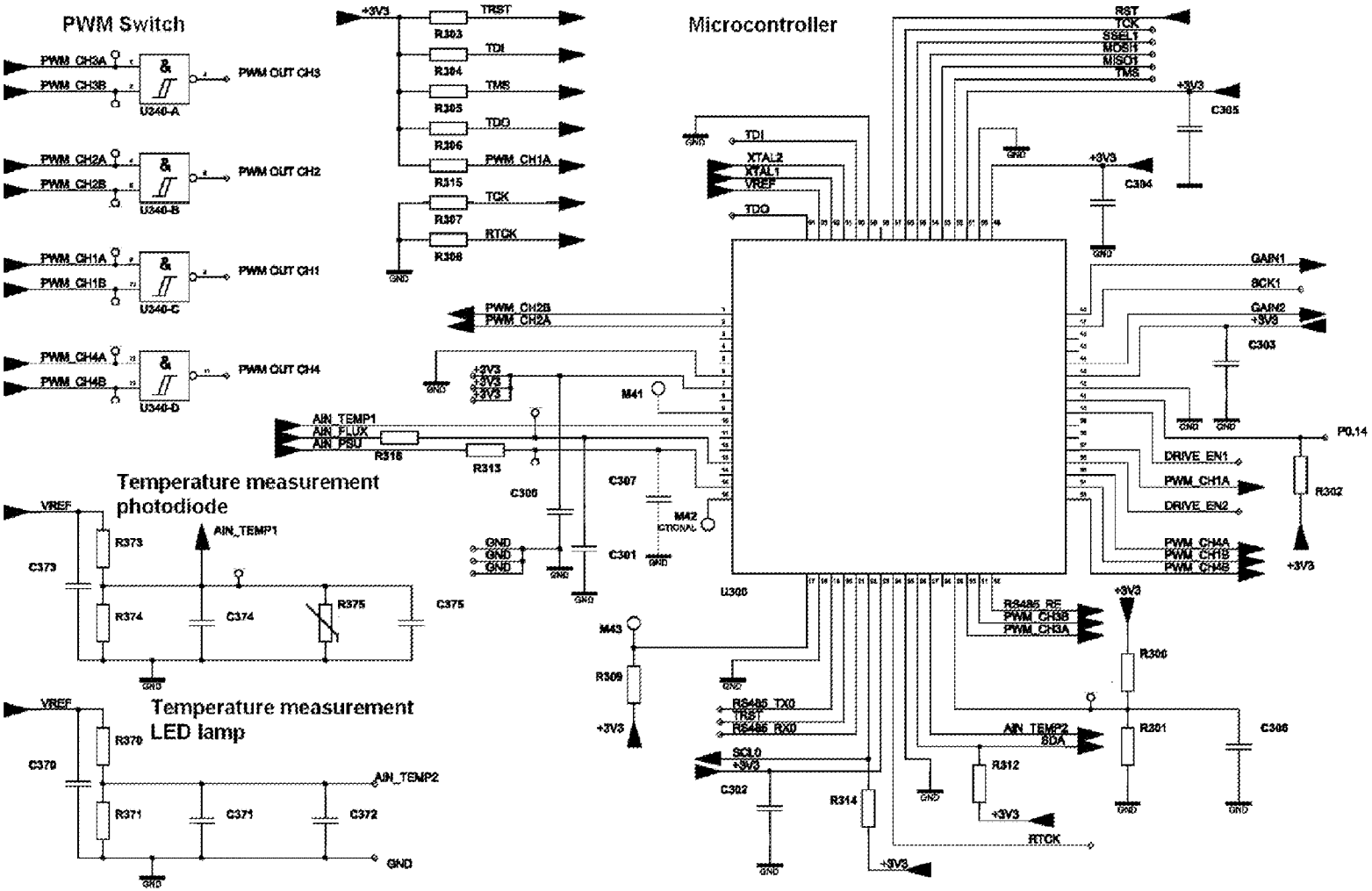
Figure 29B:
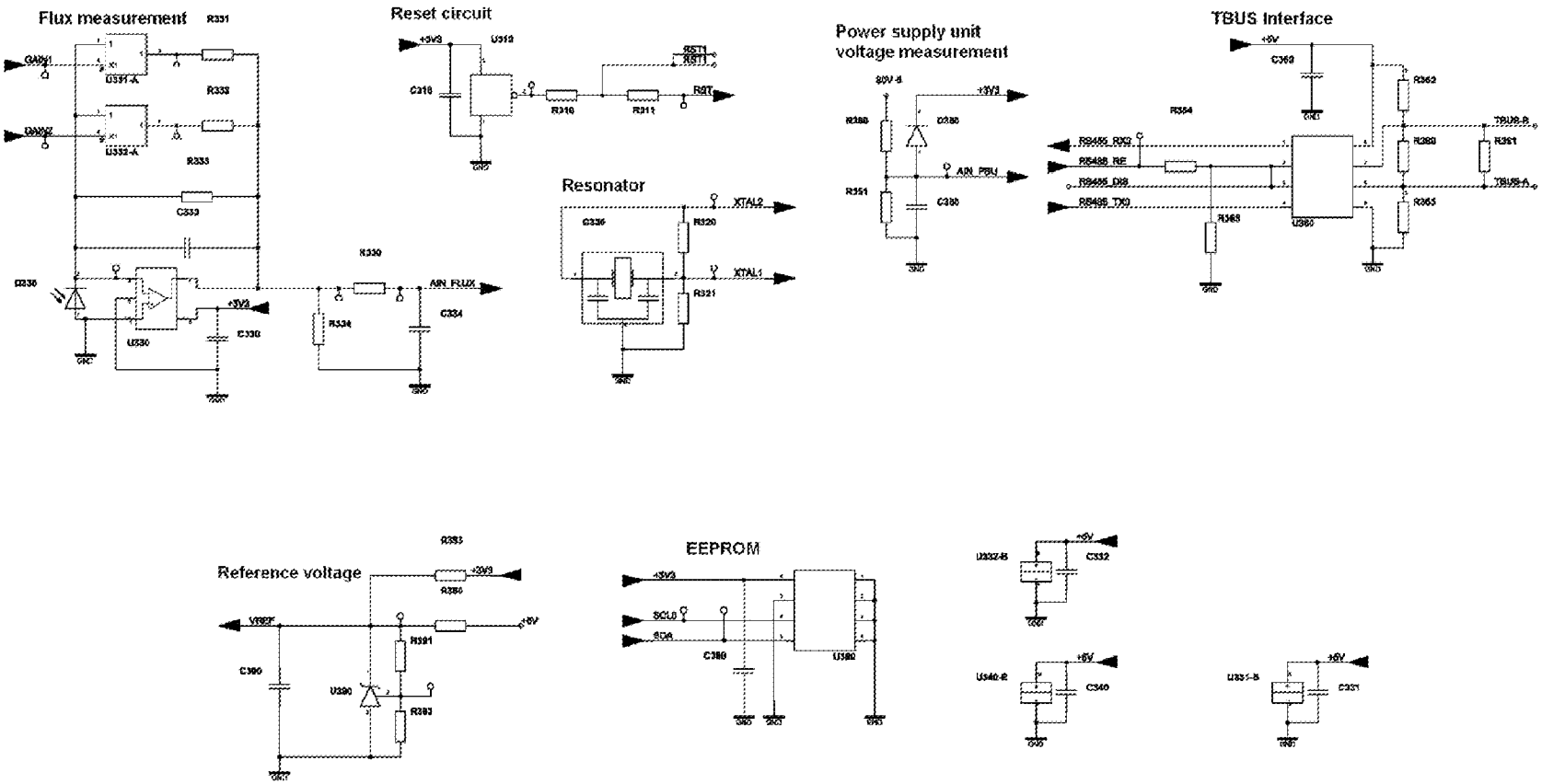

If a strip is used, the ends 1608 of the strip can be aligned and located in position under a T-section ridge 1609 protruding from the inner surface of the cylindrical cavity. A top view of an example strip in an open, unbiased configuration is illustrated in FIG. 19. A small cut-out 1610 in the wall of the cylindrical cavity and a corresponding cut-out 1628 in the strip allow light from the LEEs to enter the upper part of light channel 1611. The lower part of light channel fits optical sensor 1612 on the folded PCB 1613 when the light engine is assembled. An optional infrared filter may be placed over the optical sensor which can help improve signal to noise ratio of the signal provided by the sensor.

The lighting device 1600 is configured so that in the assembled configuration a small portion of the light within the cylindrical cavity is allowed to leak into a light channel 1611 at the end of which is disposed the optical sensor. Located at the end of the cylindrical cavity, opposite the LEEs, is a small aperture through which a small fraction of light from the LEEs can propagate to the optical sensor 1612. Due to the reflections of light occurring within the cavity, the amount of light that can propagate through light channel 1611 varies little with position variations of the individual LEEs of the LEE circuit board 1617.

In the assembled configuration, a diffuser 1605 is disposed within the exit aperture of the cylindrical cavity 1627. A cover 1606 with aperture 1607 is attached to the upper face of housing 1603. The cover 1606 holds the diffuser 1605 in place and covers the upper end of the light channel 1611. The diffuser may comprise one or more elements made of translucent plastic, semi-translucent plastic, ground glass, holographic or other type of diffuser or a combination of these or other elements as would be readily understood by a person skilled in the art.

FIGS. 20 to 26 illustrate schematics of an example drive circuit for use in, for example, the lighting device illustrated in FIG. 16. The drive circuit includes a switched-mode DC-DC power converter of a hysteretic buck converter type. Hysteretic buck converters can be turned ON and OFF rapidly and provide very short turn on times. In the present embodiment the converters are configured as current sources. They can also switch off power substantially completely in OFF configurations and consequently conserve energy. For example, in the schematics shown in FIGS. 23 and 24, signals labelled DRIVE_EN1 and DRIVE_EN2 allow the current sources to be substantially completely disabled when not required thus preventing substantially any power from being dissipated by the drive circuitry or LEEs which are connected thereto.

Figure 30:
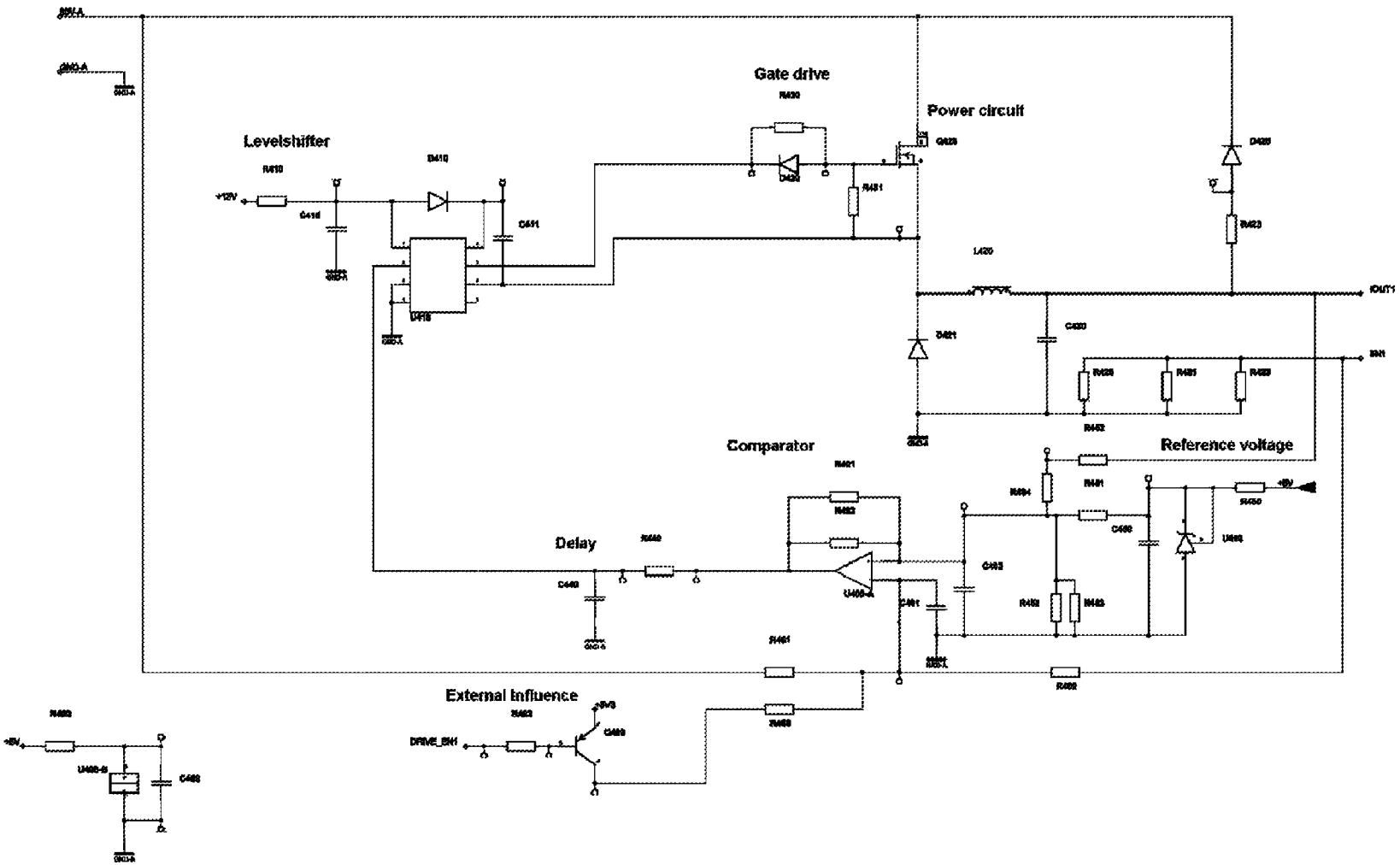
Figure 31:
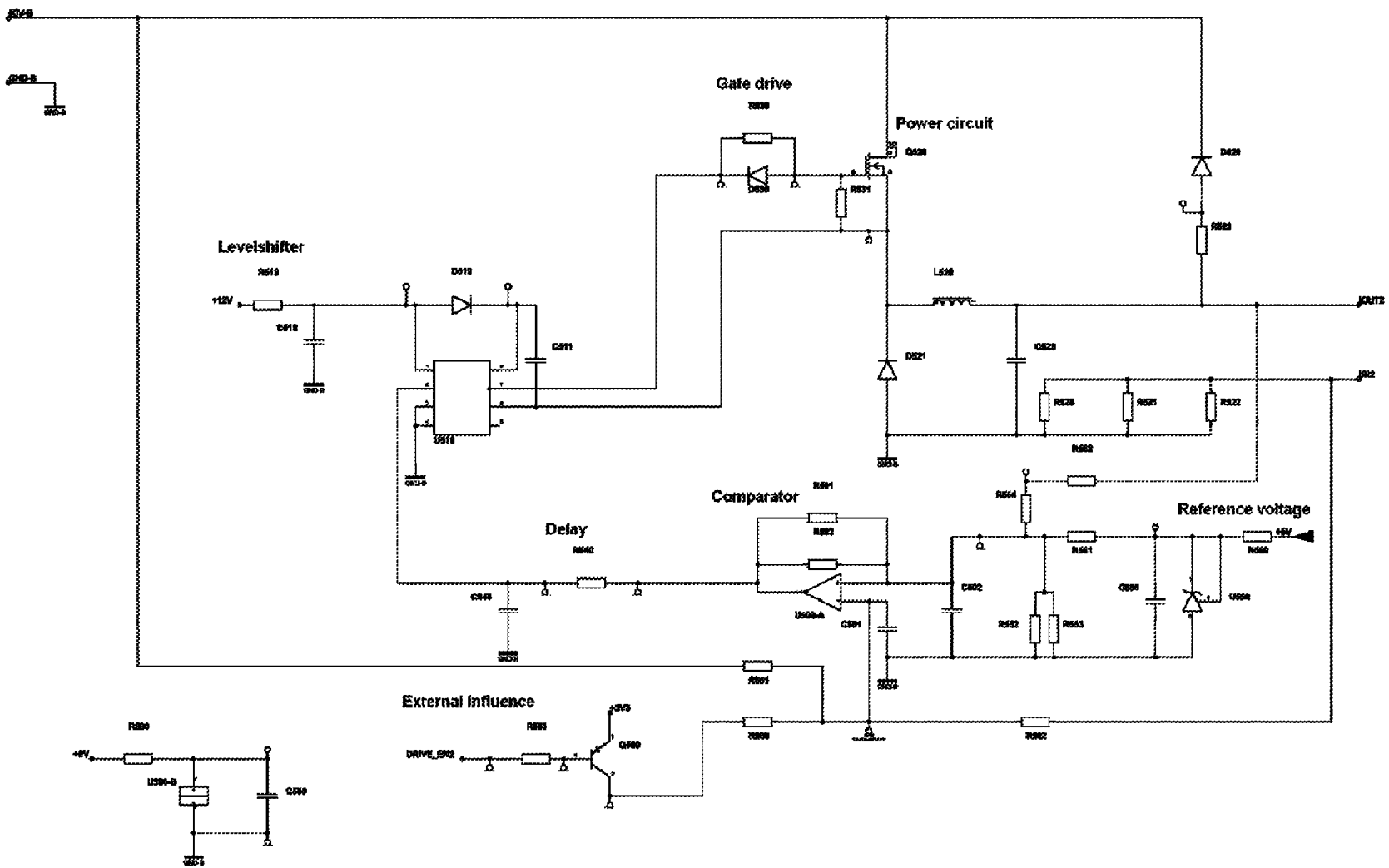
Figure 32:
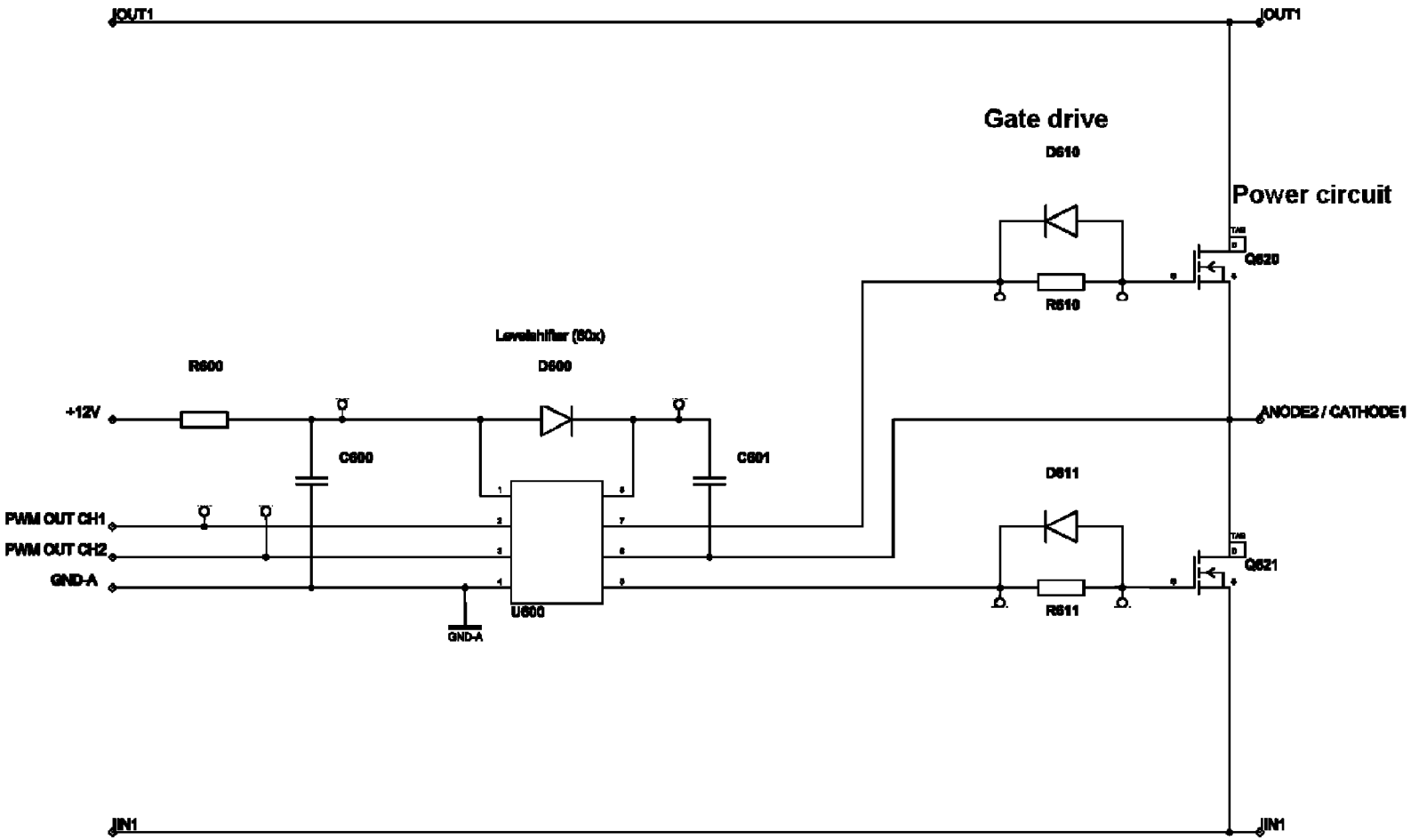
Figure 33:
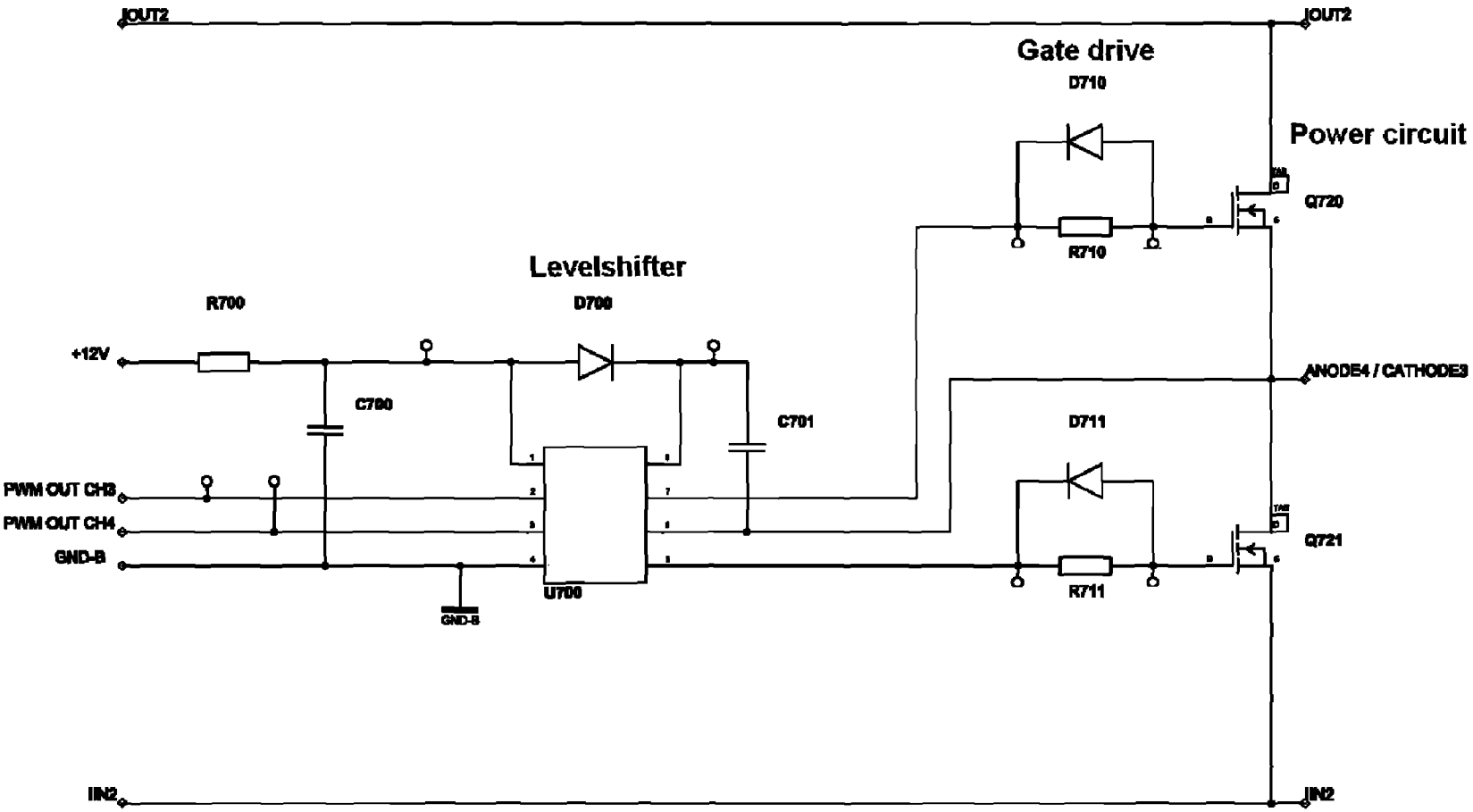

FIGS. 27 to 33 illustrate schematics of another example drive circuit for use in, for example, the lighting device illustrated in FIG. 16. In this embodiment certain modifications are applied to the drive circuitry. For example, as shown in FIGS. 30 and 31, additional parallel resistors are added to provide more precise control of the hysteresis thresholds thereby providing more control and flexibility of the current waveform generated by the hysteretic buck converters.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto; inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Accordingly, as indicated above, the foregoing embodiments of the invention are examples and can be varied in many ways. Such present or future variations are not to be regarded as a departure from the spirit and scope of the invention, and all such modifications as would be apparent to one skilled in the art are intended to be included within the scope of the following claims.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein, the term "about" refers to a +/−10% variation from the nominal value. It is to be understood that such a variation is always included in any given value provided herein, whether or not it is specifically referred to.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc. It should also be understood that, unless clearly indicated to the contrary, in any methods claimed herein that include more than one step or act, the order of the steps or acts of the method is not necessarily limited to the order in which the steps or acts of the method are recited. In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

We claim:

1. A solid-state lighting device comprising:

a plurality of light-emitting elements for generating light, including at least one light-emitting element having a first surface area;

a heat spreading chassis thermally connected to the plurality of light emitting elements, said heat spreading chassis configured for coupling to at least one heat sink;

a mixing chamber optically coupled to the plurality of light-emitting elements for mixing the light emitted by the plurality of light-emitting elements;

wherein one or more of the plurality of light-emitting elements are driven by an AC power supply;

said one or more of the plurality of light emitting elements emit light substantially perpendicular to an exit aperture of the solid-state lighting device;

a control system operatively coupled to the plurality of light-emitting elements for controlling operation of the plurality of light-emitting elements;

wherein said one or more of the plurality of light-emitting elements are operatively coupled to a flexible circuit board thermally connected to said heat spreading chassis;

said plurality of light-emitting elements further including one or more digitally controlled light-emitting elements configured to modify chromaticity or CCT of said light.

2. The solid-state lighting device according to claim 1, wherein the plurality of light-emitting elements further includes at least one light-emitting element having a second surface area, wherein the first surface area is smaller than the second surface area.

3. The solid-state lighting device according to claim 1, wherein the heat spreading chassis defines a groove formed therein for facilitating engagement with the flexible circuit board.

4. The solid-state lighting device according to claim 1, wherein the plurality of light-emitting elements includes one or more white light-emitting elements.

5. The solid-state lighting device according to claim 1, wherein the digitally controlled light-emitting elements are controlled using a feedback sensing system.

6. The solid-state lighting device according to claim 5, wherein the feedback sensing system comprises one or more sensors selected from the group consisting of: an optical sensor, voltage sensor, current sensor, and temperature sensor.

7. The solid-state lighting device according to claim 1, wherein the digitally controlled light-emitting elements include one or more green light emitting elements.

8. The solid-state lighting device according to claim 1, wherein the digitally controlled light-emitting elements include one or more green light emitting elements and one or more blue light emitting elements.

9. The solid-state lighting device according to claim 1, wherein the heat spreading chassis includes at least one groove formed therein for facilitating engagement with said flexible circuit board.

10. The solid-state lighting device according to claim 1, wherein said light-emitting elements have at least one light-emitting element with a second surface area, wherein said first surface area is smaller than said second surface area.

* * * * *